US008061101B2

(12) United States Patent
Culpepper

(10) Patent No.: US 8,061,101 B2
(45) Date of Patent: Nov. 22, 2011

(54) INSULATING SIDING SYSTEM

(75) Inventor: Jason Lee Culpepper, Massillon, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 81 days.

(21) Appl. No.: 12/388,798

(22) Filed: Feb. 19, 2009

(65) Prior Publication Data

US 2010/0064616 A1 Mar. 18, 2010

Related U.S. Application Data

(60) Provisional application No. 61/096,374, filed on Sep. 12, 2008.

(51) Int. Cl.
*E04B 2/00* (2006.01)

(52) U.S. Cl. ..... 52/551; 52/483.1; 52/386; 52/510

(58) Field of Classification Search ..... 52/483.1, 52/489.1, 506.08, 510, 511, 555, 384, 386, 52/550, 551, 556, 385, 387
See application file for complete search history.

(56) References Cited

U.S. PATENT DOCUMENTS

| | | | | | |
|---|---|---|---|---|---|
| 1,707,347 | A | * | 4/1929 | Dunbar | 52/510 |
| 2,066,268 | A | * | 12/1936 | Hohner | 52/275 |
| 2,114,155 | A | * | 4/1938 | Streich | 52/274 |
| 2,832,102 | A | * | 4/1958 | Amoruso | 52/386 |
| 3,005,293 | A | * | 10/1961 | Hunter | 52/385 |
| 3,417,531 | A | * | 12/1968 | Jones | 52/520 |
| 3,605,369 | A | * | 9/1971 | Merrill et al. | 52/530 |
| 3,826,054 | A | | 7/1974 | Culpepper, Jr. | |
| 4,134,244 | A | * | 1/1979 | Sjolander | 52/506.1 |
| 4,238,915 | A | * | 12/1980 | Yoshida et al. | 52/510 |
| 4,262,464 | A | * | 4/1981 | Ludowici | 52/510 |
| 4,803,821 | A | * | 2/1989 | Funaki | 52/387 |
| 4,856,245 | A | * | 8/1989 | Osawa | 52/386 |
| 4,856,246 | A | * | 8/1989 | Shimasaki | 52/386 |
| 4,890,433 | A | * | 1/1990 | Funaki | 52/386 |
| 4,916,875 | A | * | 4/1990 | Kashiwagi | 52/302.3 |
| 4,961,295 | A | * | 10/1990 | Kosch et al. | 52/36.5 |
| 5,029,425 | A | * | 7/1991 | Bogataj | 52/482 |
| 5,277,009 | A | * | 1/1994 | Yamaguchi et al. | 52/387 |
| 5,390,457 | A | * | 2/1995 | Sjolander | 52/387 |
| 5,544,461 | A | * | 8/1996 | Sommerstein | 52/235 |
| 6,044,609 | A | * | 4/2000 | Kim | 52/551 |
| 6,289,647 | B1 | * | 9/2001 | Sjolander | 52/510 |
| 7,207,145 | B2 | | 4/2007 | Stucky et al. | |
| 7,779,594 | B2 | * | 8/2010 | Mowery et al. | 52/539 |

FOREIGN PATENT DOCUMENTS

| | | | |
|---|---|---|---|
| DE | 3539894 | A1 * | 5/1987 |
| FR | 2659999 | A1 * | 9/1991 |

* cited by examiner

*Primary Examiner* — Robert Canfield
*Assistant Examiner* — Christine T Cajilig
(74) *Attorney, Agent, or Firm* — Fay Sharpe LLP; Richard M. Klein

(57) ABSTRACT

An insulating siding system contains two components: a sheathing panel and a siding panel. The sheathing panel contains slots or grooves, while the siding panel contains connectors that fit into the slots or grooves. The siding panels are fit or attached to the sheathing panel without the need for fasteners, such as nails or staples, to penetrate the siding panel, creating a uniform exterior.

14 Claims, 17 Drawing Sheets

INSULATING SIDING SYSTEM

CROSS-REFERENCE TO RELATED APPLICATIONS

This application claims priority to U.S. Provisional Patent Application Ser. No. 61/096,374, entitled FOAM SHEATHING WITH INTEGRAL SIDING RECEIVERS OR CONNECTORS and filed on Sep. 12, 2008. That application is hereby fully incorporated by reference herein.

BACKGROUND

The present disclosure relates to systems for providing insulation and siding panels on the exterior of a building, such as a house. Methods and processes for making and/or using such insulating siding systems are also disclosed.

In a building structure, such as a house, a frame is typically built. An exterior wall of plywood or material of similar function is then placed upon the frame to provide an exterior surface. A weatherproofing layer may cover the exterior wall. An insulation layer can then be placed, and finally a cladding, paneling, veneer, or siding is placed to provide the final exterior view.

Vinyl siding is a popular substitute for wood paneling and aluminum siding. It is easily cleaned, and it is resistant to deterioration. It may also be easily installed around windows and doors. Moreover, it may be produced in a variety of shapes and colors by known extrusion and molding processes at a relatively low cost per sheet or panel.

To enhance the thermal insulation of building structures, one or more layers of insulating material can be placed between the vinyl siding and the exterior wall of the building. For example, a layer of insulation can be placed on a exterior wall, and the vinyl siding then installed over the insulating layer. In other insulated siding systems, an insulated panel is generally attached to a veneer, such as a vinyl siding panel.

Current insulation and exterior finishing products are complex to install and have performance shortcomings. For example, rigid insulating sheathing and siding are installed in two separate steps and function separately from one another as well. The installation of insulation and siding is a two-step process that is complicated, time-consuming and requires the installer to put excessive penetrations into the walls of a building, creating areas that are vulnerable to moisture intrusion. Because the fasteners used to attach siding panels to a wall restrict the movement of the panels, visual defects due to thermal expansion can occur as well. Also, when installing plank siding product, there is no natural alignment from course to course integrated into the siding product or the sheathing product. This forces the installer to strike chalk lines or use other secondary alignment devices, increasing the time and cost of the installation.

It would be desirable to produce additional insulated siding panel systems or assemblies that allow for simple production and easy installation.

BRIEF DESCRIPTION

Disclosed in embodiments are insulating siding systems useful on the exterior surfaces or walls of a building. The insulating siding systems contain rigid foam insulation, which provides strength to the insulated siding system, enables a wide variety of design options, and provides increased R-values.

Generally, the insulating siding systems include a foam sheathing product having integral siding receivers or connectors that allow easy, straight alignment and fastening of a siding panel or façade that is equipped with the complementary receiver/connector, without the use of typical fasteners like nails, staples, screws, etc. in the siding panel/façade.

In some embodiments, an insulating siding system comprising a sheathing panel and a siding panel is disclosed. The sheathing panel comprises a front surface and a rear surface, the front surface and rear surface being spaced laterally apart from each other. The front surface comprises a first slot, the first slot extending laterally into the sheathing panel and including an upwardly facing channel spaced laterally from the front surface. The siding panel comprises a front face and a first downwardly facing channel that extends rearwards and has a rear wall. The first slot is sized to receive the rear wall of the first downwardly facing channel.

In some other embodiments, an insulating siding system comprising a sheathing panel and a siding panel is disclosed. The sheathing panel comprises a front surface and a rear surface, which are spaced laterally apart from each other. The front surface comprises a first slot and a second slot. Each slot extends laterally into the sheathing panel and includes an upwardly facing channel spaced laterally from the front surface. The siding panel comprises a front face, an upper downwardly facing channel that extends rearwards and has a rear wall, and a lower downwardly facing channel that extends rearwards and has a rear wall. The first slot is sized to receive the rear wall of the upper downwardly facing channel and the second slot is sized to receive the rear wall of the lower downwardly facing channel.

In other embodiments, an insulating siding system comprising a sheathing panel and a siding panel is disclosed. The sheathing panel comprises a rear surface and a forward surface. The forward surface comprises a first row and a second row. The two rows extend laterally from the forward surface to define a front surface. The second row has a ridge extending upwardly at the front surface between the first row and the second row to define a slot. The siding panel comprises a front face having an upper edge and a lower edge. A lower downwardly facing channel extends rearwards from the lower edge and has a rear wall. The slot is sized to receive the rear wall of the lower downwardly facing channel.

In still other embodiments, an insulating siding system comprises a sheathing panel and a siding panel. The sheathing panel comprises a front surface and a rear surface, which are spaced laterally apart from each other. The front surface comprises a first slot and a second slot. Each slot comprises an upper surface extending laterally into the front surface, a rear surface extending downwards from the upper surface, a lower surface extending from the rear surface laterally towards the front surface for a lower surface width, a forward surface extending upwards from the lower surface for a forward surface height, a medial surface extending from the forward surface to the front surface for a medial surface width, and a slot entry height between the upper surface and the medial surface. The siding panel comprises a front face and a rear face, an upper channel wall extending rearwards from the rear face and having an upper channel wall width, an upper channel rear wall extending downwards from the upper channel wall and having an upper rear wall height, a bottom wall extending rearwards from the rear face, a lower channel front wall extending upwards from the bottom wall, a lower channel top wall extending rearwards from the lower channel front wall and having a lower top wall width, and a lower charnel rear wall extending downwards from the lower channel top wall and having a lower rear wall height. The slot entry height of the first slot is equal to or greater than the upper rear wall height and the slot entry height of the second slot is equal to or greater than the lower rear wall height.

In still other embodiments, an insulating siding system comprises a sheathing panel and a siding panel. The sheathing panel comprises a front surface and a rear surface. The front surface comprises a first slot and a second slot. Each slot extends rearwards into the sheathing panel and includes an upwardly facing channel spaced apart from the front surface. The siding panel comprises a front face, a rear face, an upper connecting wall extending rearwards from an upper portion of the rear face, an upper rear wall extending downwards from the upper connecting wall, and a lower rear wall connected to a lower portion of the rear face by a lower connecting wall and extending downwards from the lower connecting wall. The first slot is sized to receive the upper rear wall and the second slot is sized to receive the lower rear wall.

Disclosed in yet other embodiments are insulating siding systems comprising a sheathing panel and a siding panel. The sheathing panel comprises a front surface and a rear surface. The front surface comprises a first slot and a second slot. Each slot extends rearwards into the sheathing panel and includes (i) an upwardly facing channel spaced from the front surface; (ii) a lip along the front surface having a lip height; and (iii) a slot entry height. The siding panel comprises a front face and a rear face. An upper downwardly facing channel extends rearwards from an upper portion of the rear face. A lower upwardly facing channel extends rearwards from a lower portion of the rear face, and a lower downwardly facing channel extends rearwards from the lower upwardly facing channel. The first slot entry height is sized to allow the first slot lip to enter the upper downwardly facing channel and the second slot entry height is sized to allow the second slot lip to enter the lower downwardly facing channel.

In some other embodiments, an insulating siding system comprises a sheathing panel and a siding panel. The sheathing panel comprises a front surface and a rear surface. The front surface comprises a slot having a slot entry height and extends rearwards into the sheathing panel to form a cavity having a cavity height. The cavity height is greater than the sot entry height. The siding pane comprises a front face and a rear face, a connecting wall extending from the ear face, and a rear wall extending transversely from the connecting wall. The rear wall has a height that is greater than the slot entry height.

In still more embodiments, an insulating siding system comprises a sheathing panel and a siding panel. The siding panel comprises a front face and a rear face. The rear face comprises a receptacle that has a receptacle entry height and extends into the siding panel to form a cavity having a cavity height. The cavity height is greater than the receptacle entry height. The sheathing panel comprises a front face and a rear face, a connecting wall extending from the front face, and a front wall extending transversely from the connecting wall. The front wall has a height that is greater than the receptacle entry height.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
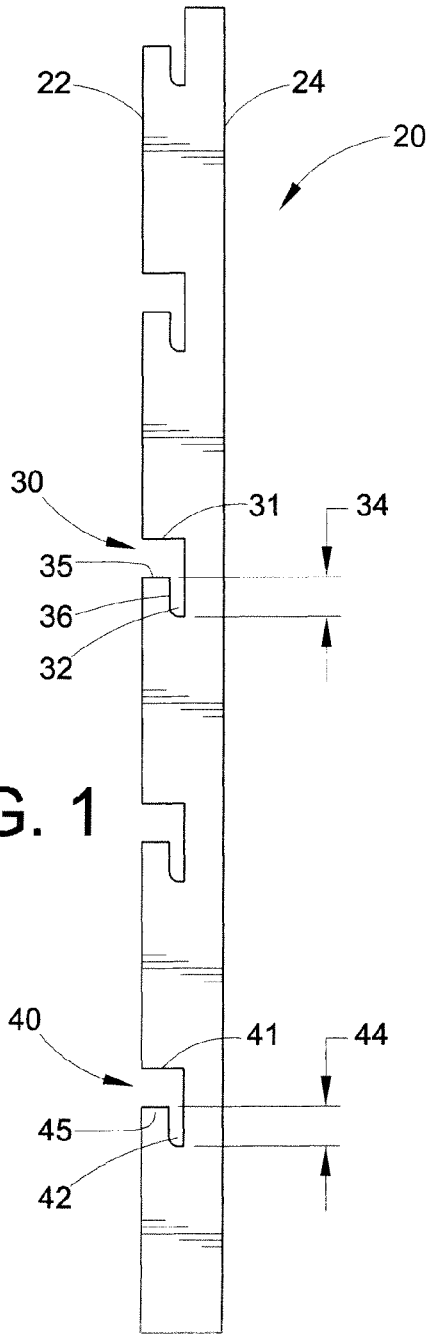
FIG. 1 is a side view of an exemplary embodiment of a sheathing panel used in the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The insulating siding systems of the present disclosure comprise a combination of a sheathing panel and a siding panel. Various embodiments of sheathing panels and siding panels will be described herein. Generally, any sheathing panel can be combined with any siding panel.

Figure 2:
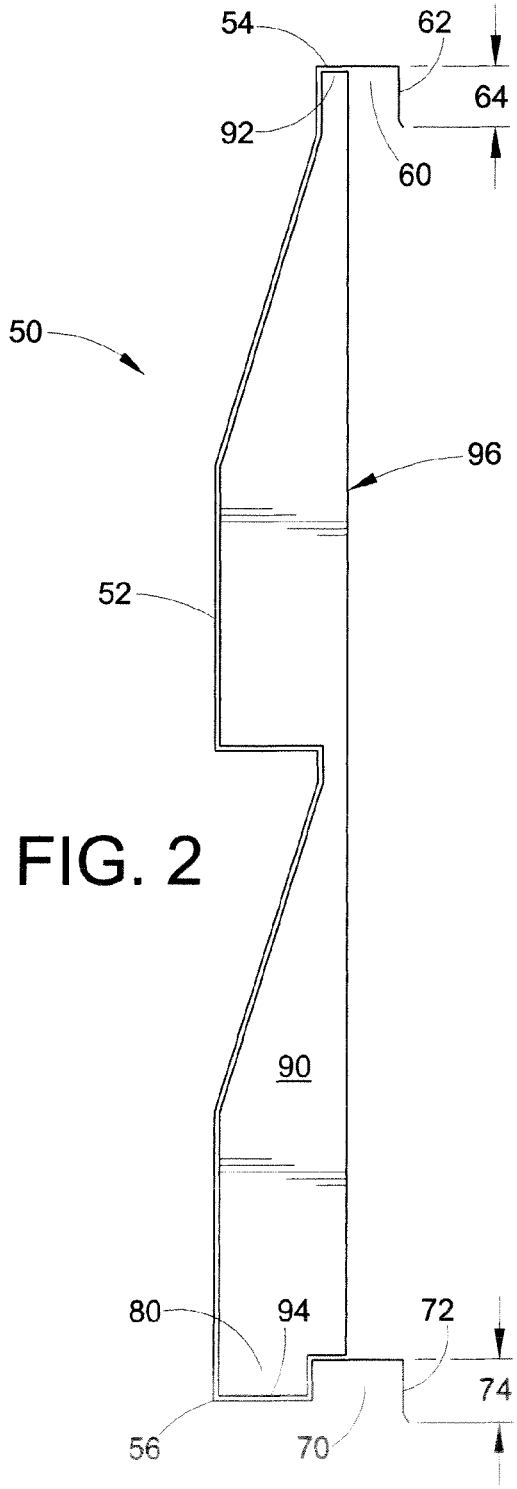
FIG. 2 is a side view of an exemplary embodiment of a siding panel used in the present disclosure.
Figure 3:
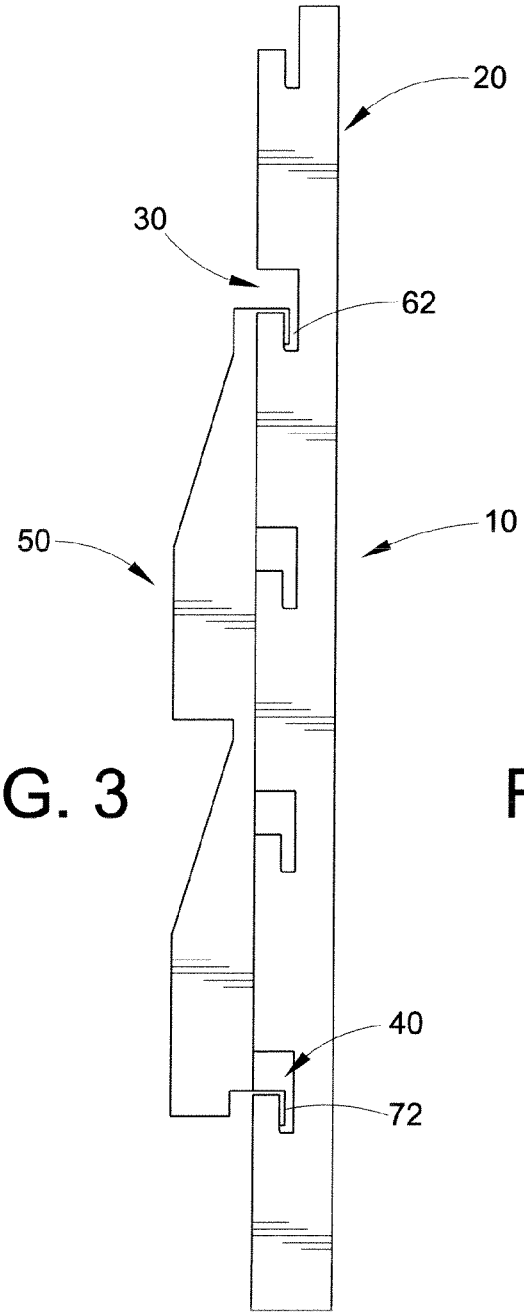
FIG. 3 is a side view of an exemplary embodiment of the panels of FIGS. 1 and 2 attached to each other.

In some embodiments, referring to FIGS. 1-3, the insulating siding system 10 comprises a sheathing panel 20 and a siding panel 50. The sheathing panel 20 comprises a front surface 22 and a rear surface 24 which are spaced laterally apart from each other. The rear surface is generally planar or flat to conform to an exterior wall. The front surface 22 comprises a first slot 30 and a second slot 40. Each slot extends laterally into the sheathing panel and includes an upwardly facing channel 32, 42 spaced laterally from the front surface 22. Alternatively, each slot may be considered has having an upper surface 31, 41, and a lower surface 35, 45, the upwardly facing channel 32, 42 being located along the lower surface. The siding panel 50 comprises a front face 52, a first downwardly facing channel 60 that extends rearwards and has a rear wall 62, and a second downwardly facing channel 70 that extends rearwards and has a rear wall 72. The first slot 30 is sized to receive the rear wall 62 of the first downwardly facing channel 60 and the second slot 40 is sized to receive the rear wall 72 of the second downwardly facing channel 70. The front face 52 may generally be contoured to provide any desired profile.

In some embodiments, the first downwardly facing channel 60 extends rearwards from an upper edge 54 of the siding panel and the second downwardly facing channel 70 extends rearwards from a lower edge 56 of the siding panel.

Generally, the upwardly facing channel 32 of the first slot 30 has a height 34 that is equal to or greater than a height 64 of the first downwardly facing channel rear wall 62. Similarly, the upwardly facing channel 42 of the second slot 40 may have a height 44 that is equal to or greater than a height 74 of the second downwardly facing channel rear wall 72.

The siding panel 50 may further comprise a lower upwardly facing channel 80 between the lower edge 56 of the siding panel and the second downwardly facing channel 70.

If desired, an insulating panel 90 may be included with the insulating siding system. The insulating panel 90 can be located between the siding panel 50 and the sheathing panel 20 when they are assembled. In particular, the insulating panel 90 can have an upper edge 92 and a lower edge 94. At a minimum, the lower edge 94 of the insulating panel extends into the lower upwardly facing channel 80. The upper edge 92 of the insulating panel can also extend into the first or upper downwardly facing channel 60. Depending on the thickness of the insulating panel, the rear face 96 of the insulating panel 90 can abut or contact the front surface 22 of the sheathing panel 20.

The upper downwardly facing channel 60 should be sized so that it can contain the lip 36 of the first slot 30. If an insulating panel 90 is also used, then the first or upper downwardly facing channel 60 should be sized to contain the upper edge 92 of the insulating panel and the lip 36 of the first slot.

Figure 4:
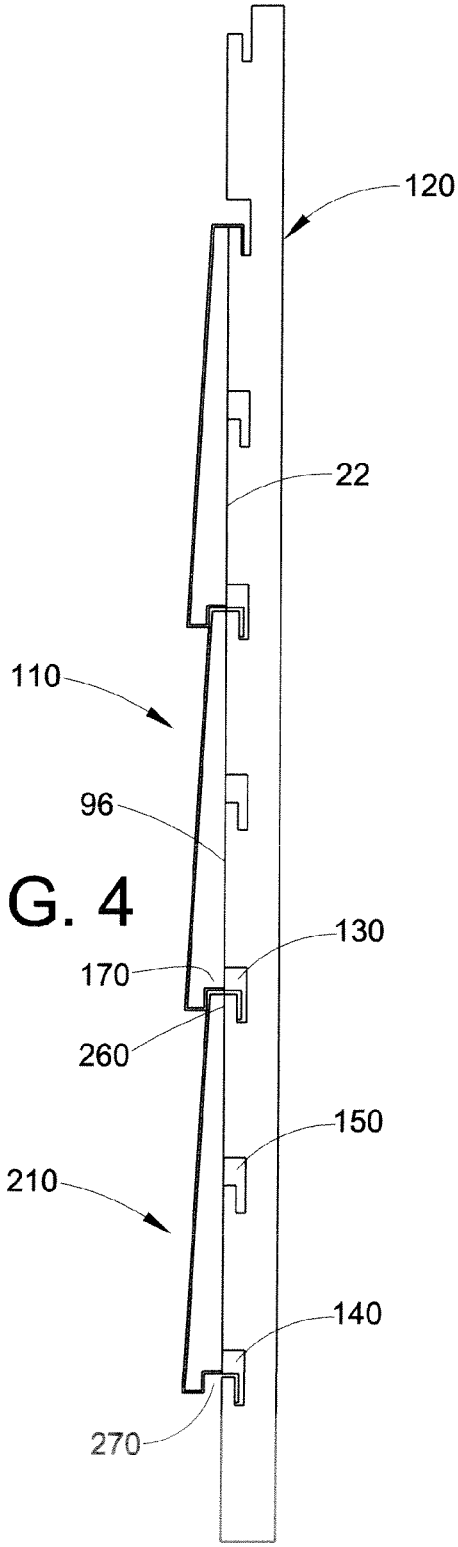
FIG. 4 is a side view of another exemplary embodiment of an insulating siding system of the present disclosure.

As seen in FIG. 4, as siding panels are integrated or connected to the sheathing panel 120, the second or lower downwardly facing channel 170 of a siding panel 110 will contain the first or upper downwardly facing channel 260 of the siding panel 210 below it. Put another way, the first or upper downwardly facing channel 260 of the siding panel is generally sized to fit within the second or lower downwardly facing channel 270.

However, this should not be construed as requiring the entire upper downwardly facing channel to fit within the lower downwardly facing channel. For example, the heights of the rear walls generally can vary. Thus, the height 74 of the lower downwardly facing channel rear wall 72 and the height 64 of the upper downwardly facing channel rear wall 62 can be the same or different. In addition, the thicknesses of the various walls of the channels may vary, as shown in later embodiments.

Again referring to FIG. 4, the two downwardly facing channels 260, 270 of the siding panel are not necessarily placed in two adjacent or consecutive slots. A third slot 150 may be located between the first slot 130 and the second slot 140.

Generally, the siding panel 210 is integrated with the sheathing panel 120 by inserting the rear wall 62 of the upper downwardly facing channel 60 into the first slot 30 and inserting the rear wall 72 of the lower downwardly facing channel 70 into the second slot 40. The siding panel 210 is then pushed downwards so that rear wall 62 enters upwardly facing channel 32 and rear wall 72 enters upwardly facing channel 42.

The first slot and the second slot need not have the same dimensions. As mentioned above, all that is required is that the first slot be sized to receive the rear wall of the upper downwardly facing channel and the second slot be sized to receive the rear wall of the lower downwardly facing channel. This feature may be helpful, for example, in specifying locations on the sheathing panel in which the siding panel(s) can and cannot be placed. However, in specific embodiments, the first slot and the second slot have the same dimensions to promote interchangeability and allow the installer to fit the panels as needed. In addition, the spacing between adjacent slots and the size of the channels, both in height and width, can vary in the various embodiments of the sheathing panel.

Figure 5:
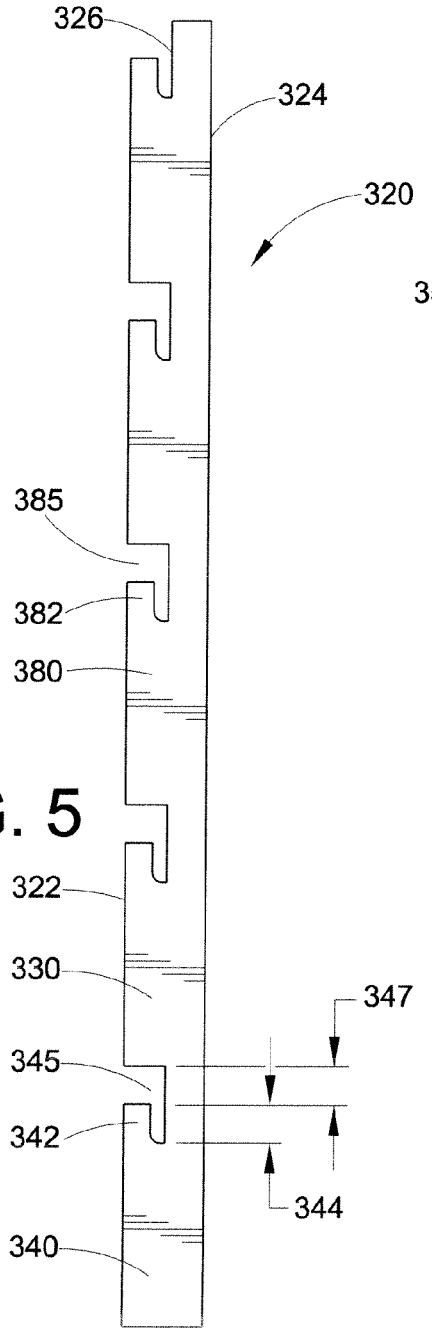
FIG. 5 is a side view of another exemplary embodiment of a sheathing panel used in the present disclosure.
Figure 6:
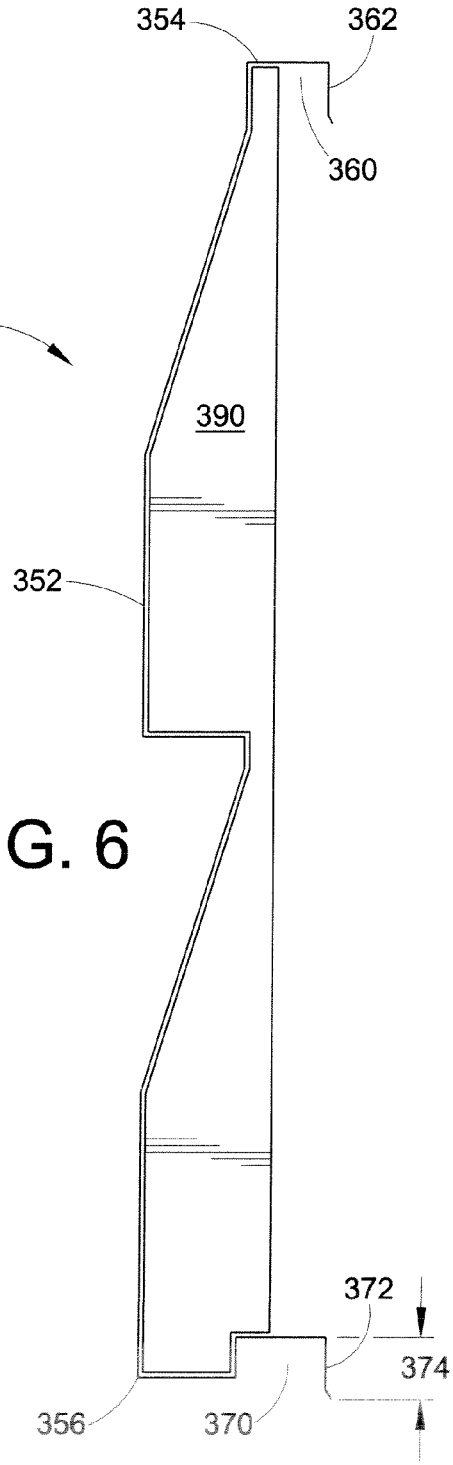
FIG. 6 is a side view of another exemplary embodiment of a siding panel used in the present disclosure.
Figure 7:
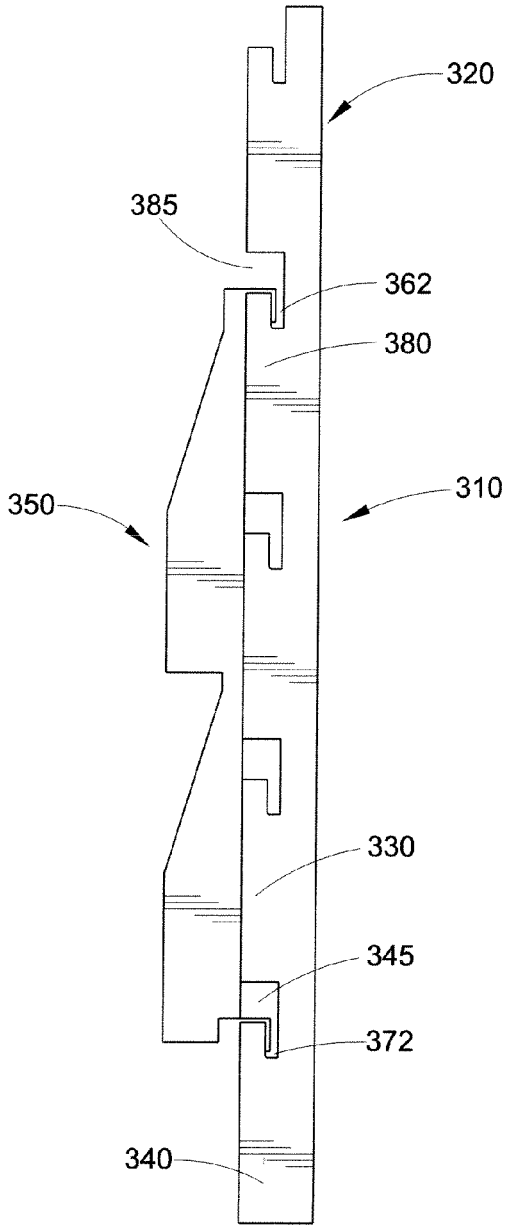
FIG. 7 is a side view of an exemplary embodiment of the panels of FIGS. 5 and 6 attached to each other.

Referring to FIGS. 5-7, the insulating siding system 310 may be considered as comprising a sheathing panel 320 and a siding panel 350. The sheathing panel 320 comprises a rear surface 324 and a forward surface 326. The forward surface 326 comprises a first row 330 and a second row 340. The two rows extend laterally from the forward surface 326 to define a front surface 322. The second row 340 has a ridge 342 extending upwardly at the front surface 322 between the first row 330 and the second row 340 to define a slot 345. The siding panel 350 comprises a front face 352 having an upper edge 354 and a lower edge 356. A lower downwardly facing channel 370 extends rearwards from the lower edge 356 and has a rear wall 372. The slot 345 on the sheathing panel is sized to receive the rear wall 372 of the lower downwardly facing channel. The ridge 342 may have a height 344 that is equal to or greater than a height 374 of the lower downwardly facing channel rear wall 372.

The siding panel 350 may further comprise an upper downwardly facing channel 360 that extends rearwards from the upper edge 354 and has a rear wall 362 as well. Again, an insulating panel 390 could be placed between the siding panel 350 and the sheathing panel 320. Again, the downwardly facing channels of the siding panel do not need to be placed in adjacent or consecutive slots on the sheathing panel. The sheathing panel 320 can further comprise a third row 380 that extends laterally from the forward surface 326 so that the first row 330 is between the third row 380 and the second row 340. The third row 380 has a ridge 382 extending upwardly at the front surface away from the first row 330 to define a third row slot 385, and the third row slot 385 is sized to receive the rear wall 362 of the upper downwardly facing channel 360.

Each ridge 342 can extend from about one-third to about two-thirds of the distance between two adjacent rows. Put in different terms, the ridge 342 has a height 344, and the slot 345 has a height 347, wherein the ratio of the slot height 347 to the ridge height 344 is from about 1:2 to about 2:1.

Figure 8:
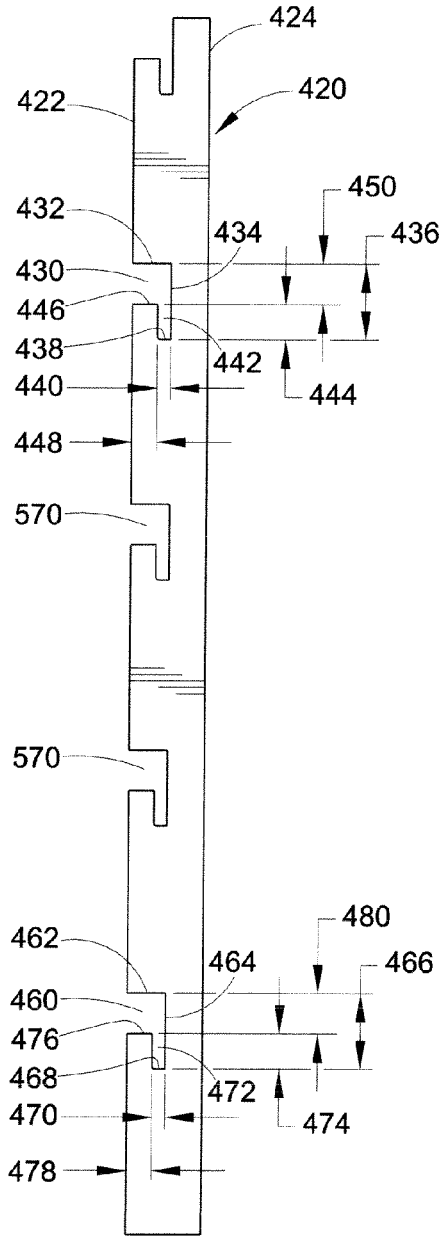
FIG. 8 is a side view of another exemplary embodiment of a sheathing panel used in the present disclosure.
Figure 9:
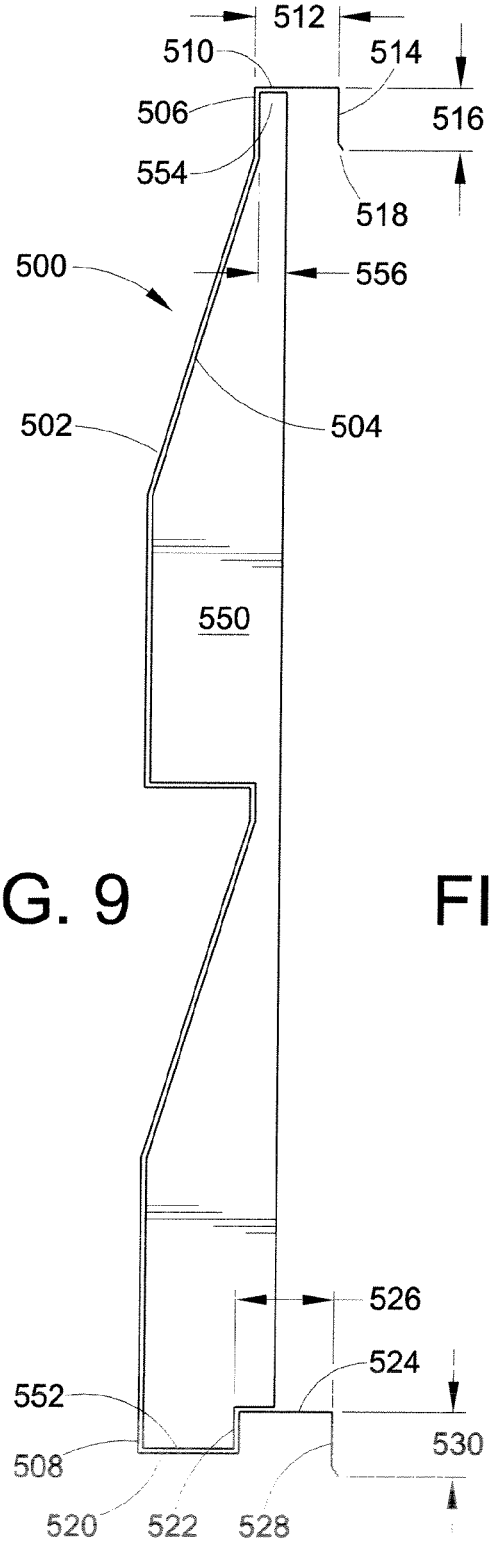
FIG. 9 is a side view of another exemplary embodiment of a siding panel used in the present disclosure.
Figure 10:
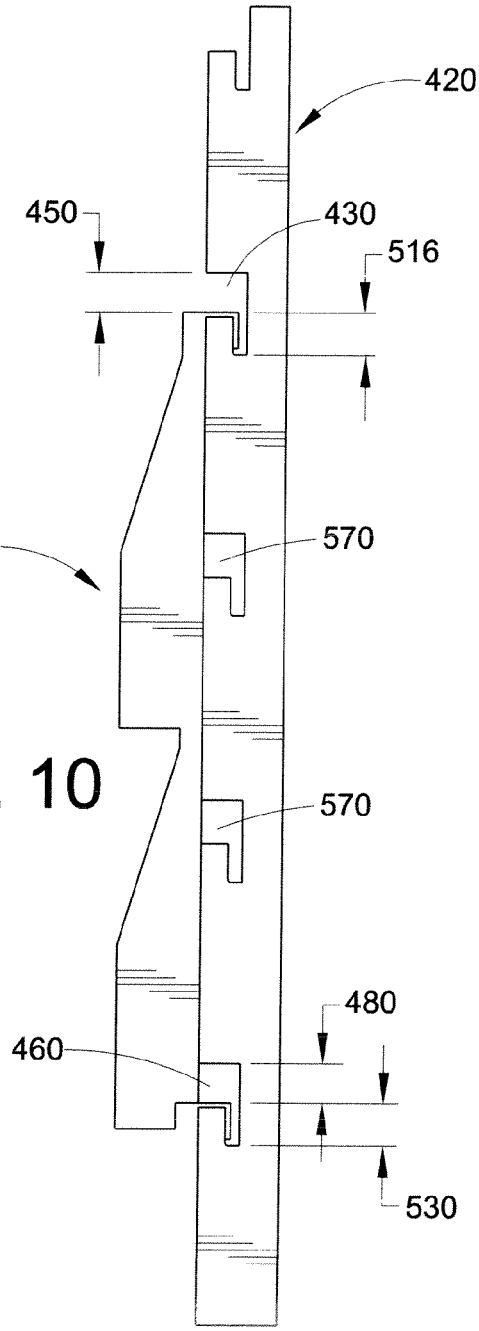
FIG. 10 is a side view of an exemplary embodiment of the panels of FIGS. 8 and 9 attached to each other.

Referring to the embodiments shown in FIGS. 8-10, the sheathing panel 420 comprises a front surface 422 and a rear surface 424 which are spaced laterally apart from each other. The front surface 422 comprises a first slot 430 and a second slot 460. Each slot 430, 460 comprises an upper surface 432, 462 extending laterally into the front surface 422, a rear surface 434, 464 extending downwards from the upper surface and having a rear surface height 436, 466, a lower surface 438, 468 extending from the rear surface laterally towards the front surface 422 for a lower surface width 440, 470, a forward surface 442, 472 extending upwards from the lower surface for a forward surface height 444, 474, a medial surface 446, 476 extending from the forward surface to the front surface for a medial surface width 448, 478, and a slot entry height 450, 480 between the upper surface 432, 462 and the medial surface 446, 476. The siding panel 500 comprises a front face 502 and a rear face 504, an upper channel wall 510 extending rearwards from the rear face and having an upper channel wall width 512, an upper channel rear wall 514 extending downwards from the upper channel wall and having an upper rear wall height 516, a bottom wall 520 extending rearwards from the rear face, a lower channel front wall 522 extending upwards from the bottom wall, a lower channel top wall 524 extending rearwards from the lower channel front wall and having a lower top wall width 526, and a lower channel rear wall 528 extending downwards from the lower channel top wall and having a lower rear wall height 530. The slot entry height 450 of the first slot 430 is equal to or greater than the upper rear wall height 516 and the slot entry height 480 of the second slot 460 is equal to or greater than the lower rear wall height 530.

In some embodiments, the upper channel wall 510 extends rearwards at an upper edge 506 of the siding panel, and the bottom wall 520 extends rearwards at a lower edge 508 of the siding panel.

The first slot forward surface height 444 can be equal to or greater than the upper rear wall height 516. Similarly, the second slot forward surface height 474 can be equal to or greater than the lower rear wall height 530.

When an insulating panel 550 is used, the lower edge 552 of the insulating panel can extend into a channel formed by the lower channel front wall 522, the bottom wall 520, and the front face 502. If desired, the upper edge 554 of the insulating panel can extend past an edge 518 of the upper channel rear wall 514. The upper channel wall width 512 should be equal to or greater than the sum of the insulating panel upper edge width 556 and the medial surface width 448.

Again, when the siding panels overlap, it is clear that the lower top wall width 526 is equal to or greater than the upper channel wall width 512. The upper rear wall height 516 and the lower rear wall height 530 can be different or the same (i.e. equal or unequal to each other). Again, the first slot 430 and second slot 460 can have the same dimensions or different dimensions. A third slot 570 can also be located between the first slot 430 and the second slot 460.

The ratio of the slot entry height 450, 480 to the forward surface height 444, 474 for each slot can be independently from about 1:2 to about 2:1. Alternatively, the forward surface height 444, 474 can be about one-third to about two-thirds of the rear surface height 436, 466.

Figure 11:
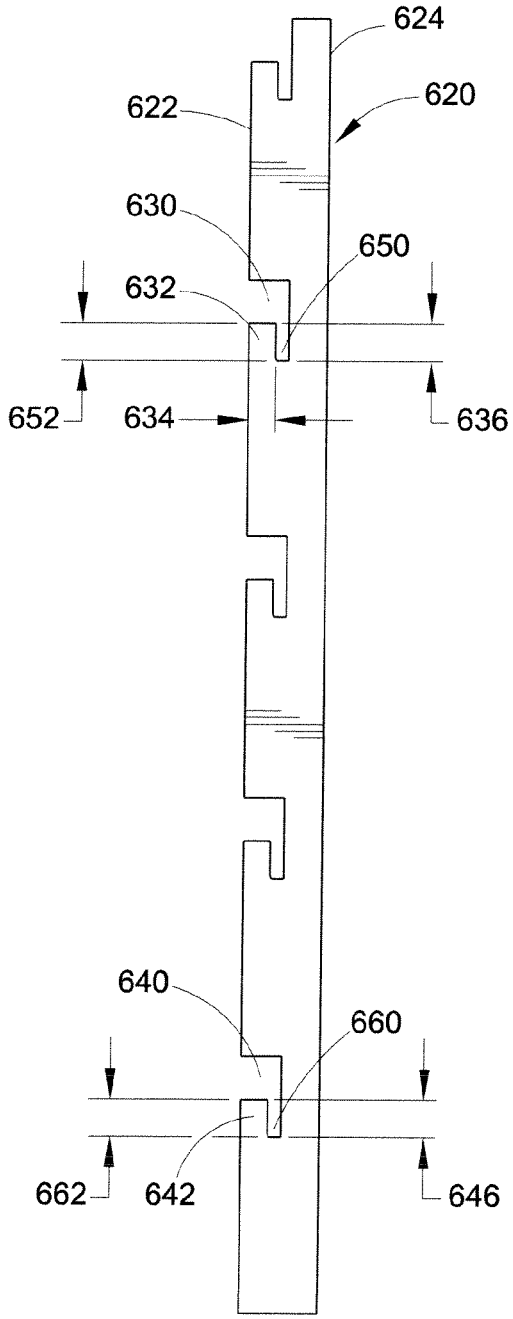
FIG. 11 is a side view of another exemplary embodiment of a sheathing panel used in the present disclosure.
Figure 12:
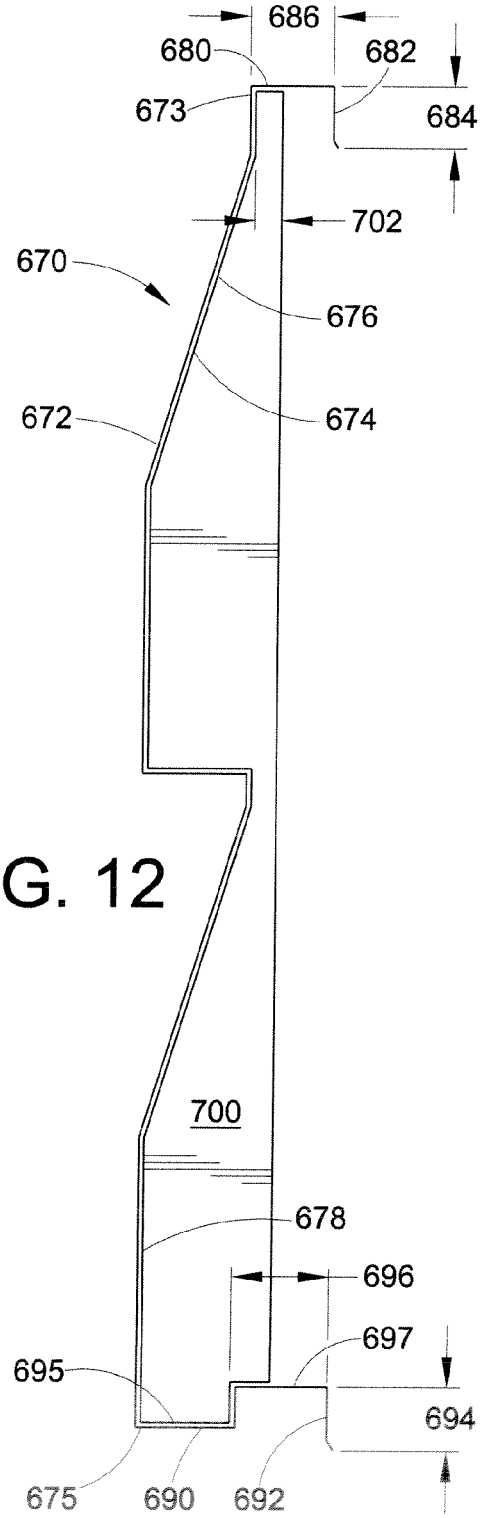
FIG. 12 is a side view of another exemplary embodiment of a siding panel used in the present disclosure.
Figure 13:
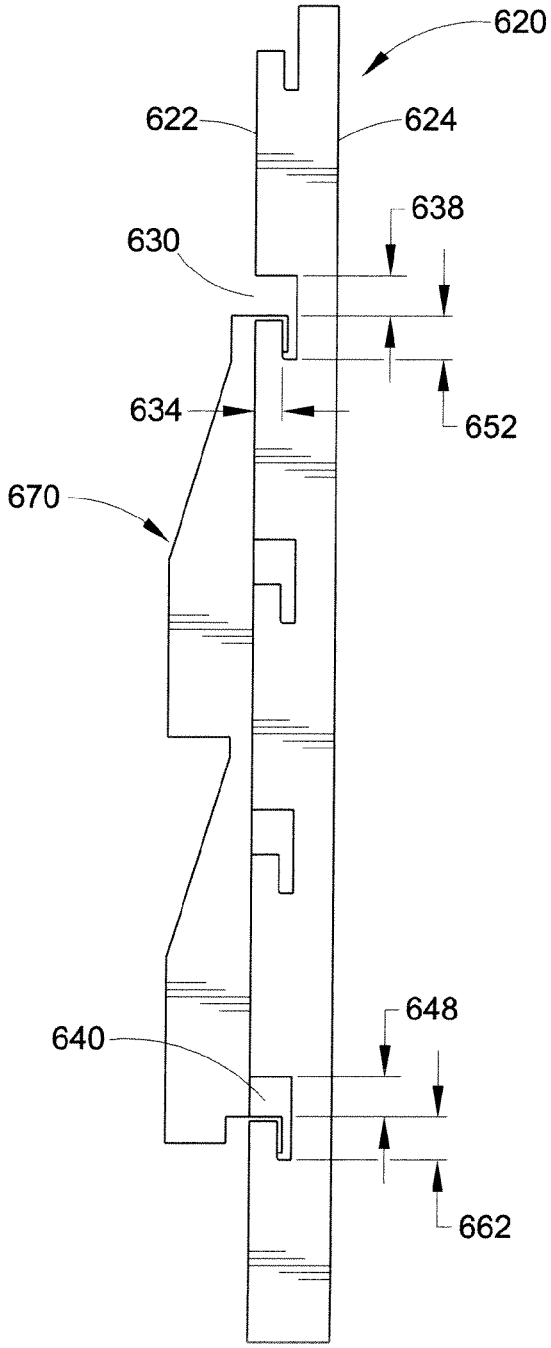
FIG. 13 is a side view of an exemplary embodiment of the panels of FIGS. 11 and 12 attached to each other.

Referring to embodiments shown in FIGS. 11-13, the sheathing panel 620 comprises a front surface 622 and a rear surface 624. The front surface 622 comprises a first slot 630 and a second slot 640. Each slot 630, 640 extends rearwards into the sheathing panel and includes an upwardly facing channel 650, 660 spaced apart from the front surface. The siding panel 670 comprises a front face 672, a rear face 674, an upper connecting wall 680 extending rearwards from an upper portion 676 of the rear face, an upper rear wall 682 extending downwards from the upper connecting wall, and a lower rear wall 692 connected to a lower portion 678 of the rear face by a lower connecting wall 690 and extending downwards from the lower connecting wall. The first slot 630 is sized to receive the upper rear wall 682 and the second slot 640 is sized to receive the lower rear wall 692. The upper connecting wall 680 can extend rearward from the upper edge 673 of the siding panel and the lower connecting wall 690 can extend rearward from the lower edge 675 of the siding panel if desired.

The height 652 of the upwardly facing channel 650 of the first slot 630 is equal to or greater than the height 684 of the upper rear wall 682. Similarly, the height 662 of the upwardly facing channel 680 of the second slot 640 is equal to or greater than the height 694 of the lower rear wall 692.

The lower connecting wall 690 can be shaped to provide a lower upwardly facing channel 695 between the front face 672 and the lower rear wall 692. An insulating panel 700 can be inserted there. A portion 697 of the lower connecting wall 690 adjacent to the lower rear wall 692 can also have a width 696 that is equal to or greater than a width 686 of the upper connecting wall 680. The upper connecting wall has a width 686 that is greater than the sum of the upper edge width 702 of the insulating panel and the lip width 634 of the first slot 630.

Figure 14:
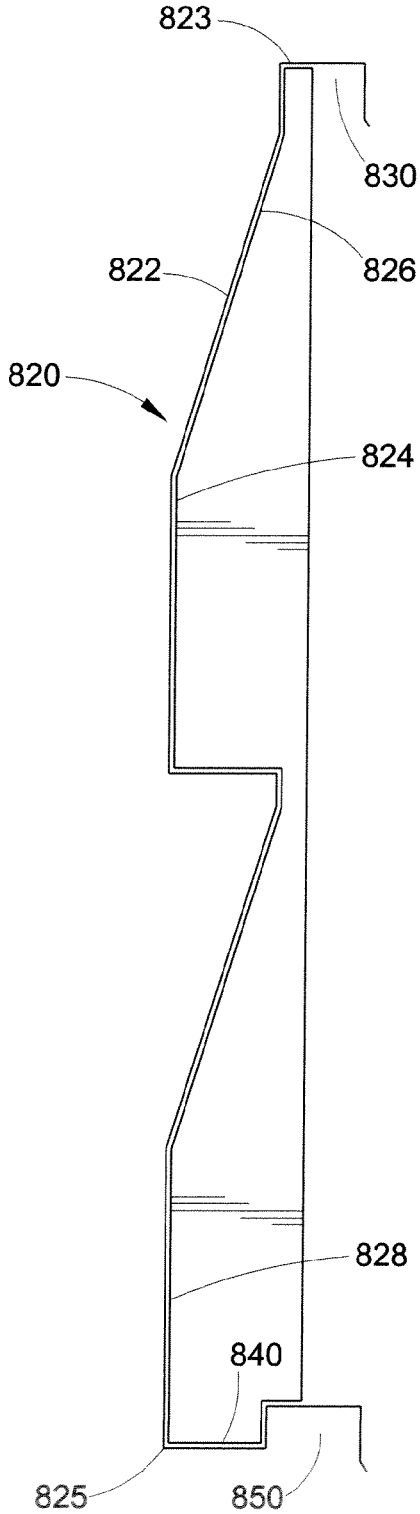
FIG. 14 is a side view of another exemplary embodiment of a siding panel used in the present disclosure.

Referring to embodiments shown in FIGS. 11, 13, and 14, the sheathing panel 620 comprises a front surface 622 and a rear surface 624. The front surface 622 comprises a first slot 630 and a second slot 640. Each slot extends rearwards into the sheathing panel and includes an upwardly facing channel 650, 660 spaced from the front surface, a lip 632, 642 along the front surface having a lip height 636, 646, and a slot entry height 638, 648. The siding panel 820 comprises a front face 822 and a rear face 824, an upper downwardly facing channel 830 extending rearwards from an upper portion 826 of the rear face, a lower upwardly facing channel 840 extending rearwards from a lower portion 828 of the rear face, and a lower downwardly facing channel 850 extending rearwards from the lower upwardly facing channel 840. The first slot entry height 638 is sized to allow the first slot lip 632 to enter the upper downwardly facing channel 830 and the second slot entry height 648 is sized to allow the second slot lip 642 to enter the lower downwardly facing channel 850. The upper downwardly facing channel 830 may extend rearward from the upper edge 823 of the siding panel and the lower upwardly facing channel 840 may extend rearward from the lower edge 825 of the siding panel.

Figure 15:
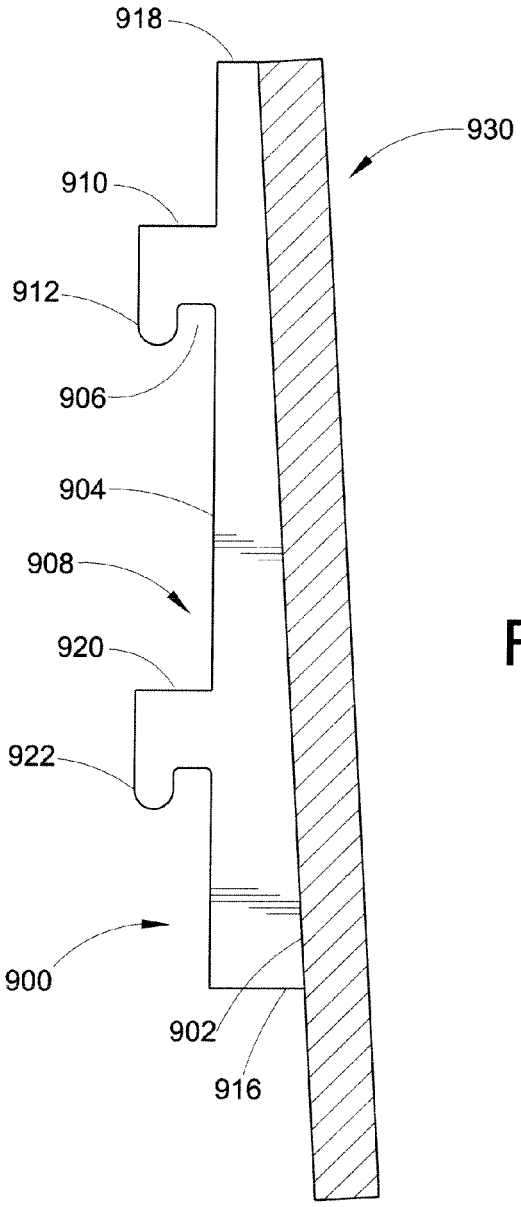
FIG. 15 is a side view of another exemplary embodiment of a siding panel used in the present disclosure.
Figure 16:
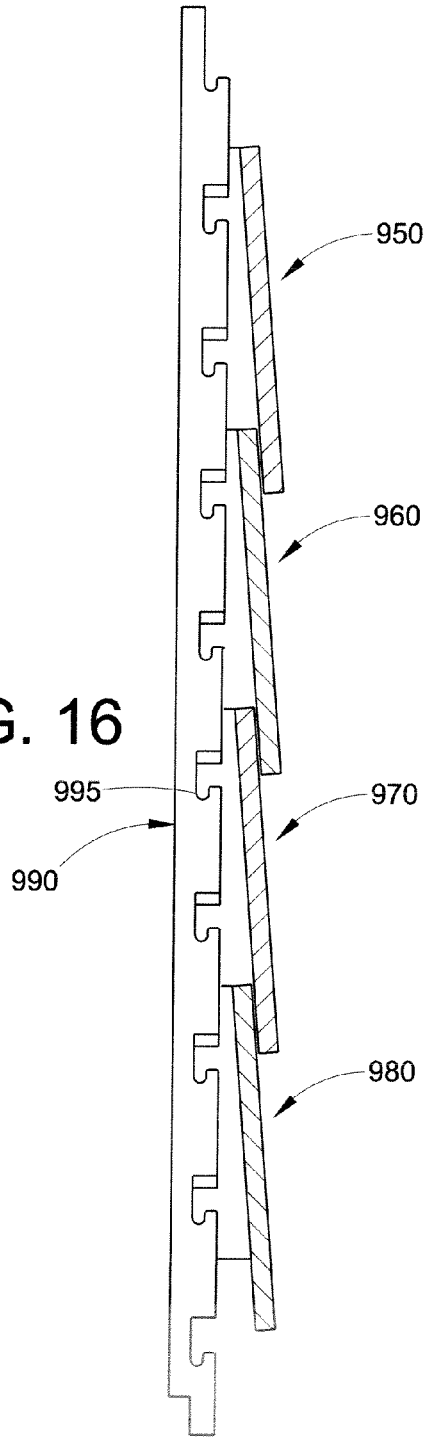
FIG. 16 is a side view of an exemplary embodiment of the panels of FIGS. 11 and 15 attached to each other.

FIG. 15 shows another embodiment of a siding panel. The siding panel 900 has a front face 902 and a rear face 904. An upper channel wall 910 extends rearward from an upper portion 906 of the rear face and an upper channel rear wall 912 extends downwards from the upper channel wall. A lower channel wall 920 extends rearward from a lower portion 908 of the rear face and a lower channel rear wall 922 extends downwards from the lower channel wall. Here, the siding panel has a veneer panel 930 attached to the front face. The veneer pane 930 can extend below the lower edge 916 of the siding panel, but generally does not extend above the upper edge 918 of the siding panel. FIG. 16 shows a plurality of such siding panels 950, 960, 970, 980 when they are attached to the sheathing panel 990. Note that the cross-section of the channels 995 is different compared to that of FIG. 11. Instead of being a straight line, the bottom of the channel is rounded. Also note that the thicknesses of the walls 910, 912, 920, 922 are different compared to those of, for example, FIG. 9. Such differences are contemplated as being within the scope of the present disclosure.

Figure 17:
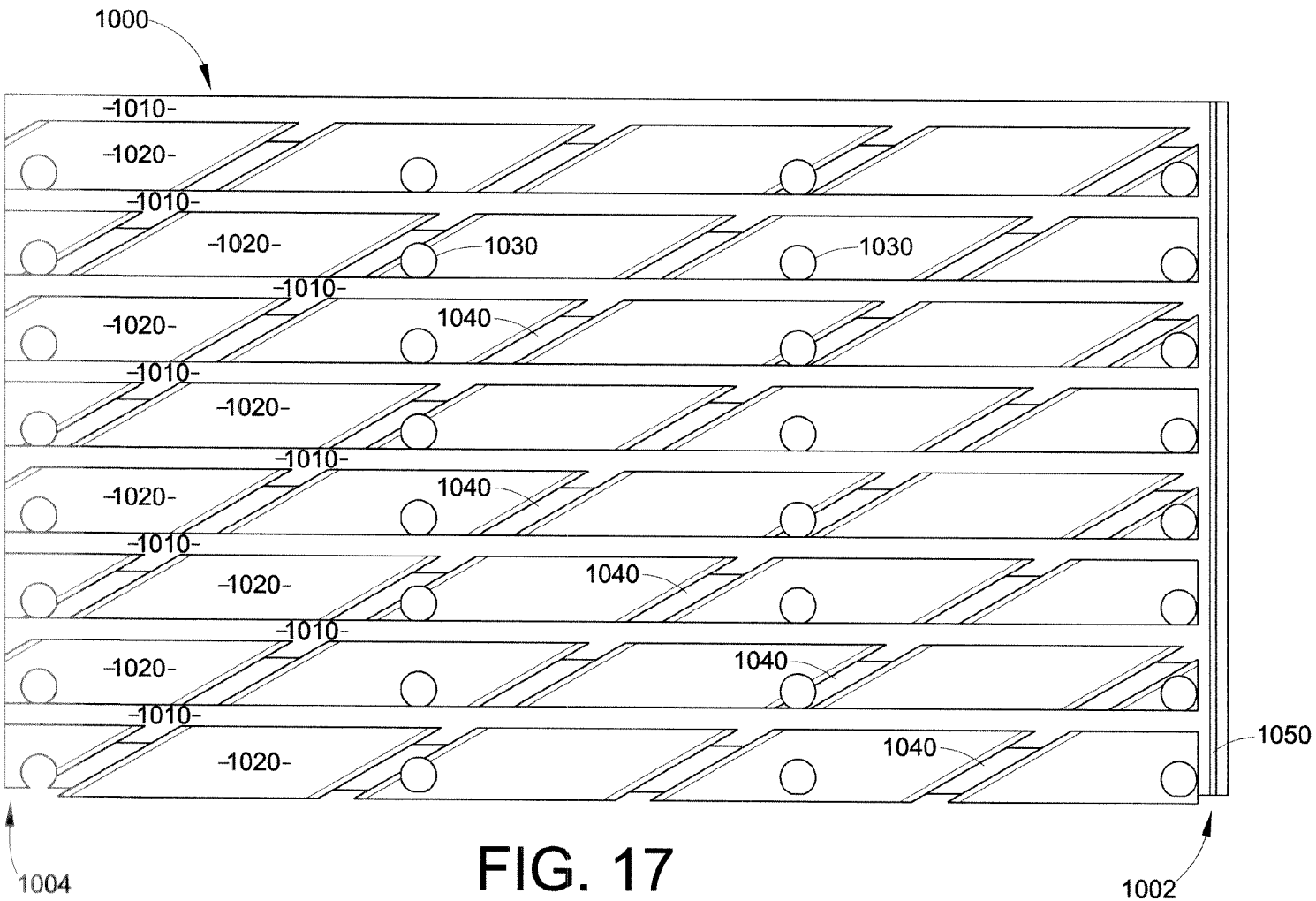
FIG. 17 is a front view of another exemplary embodiment of a sheathing panel of the present disclosure.
Figure 18:
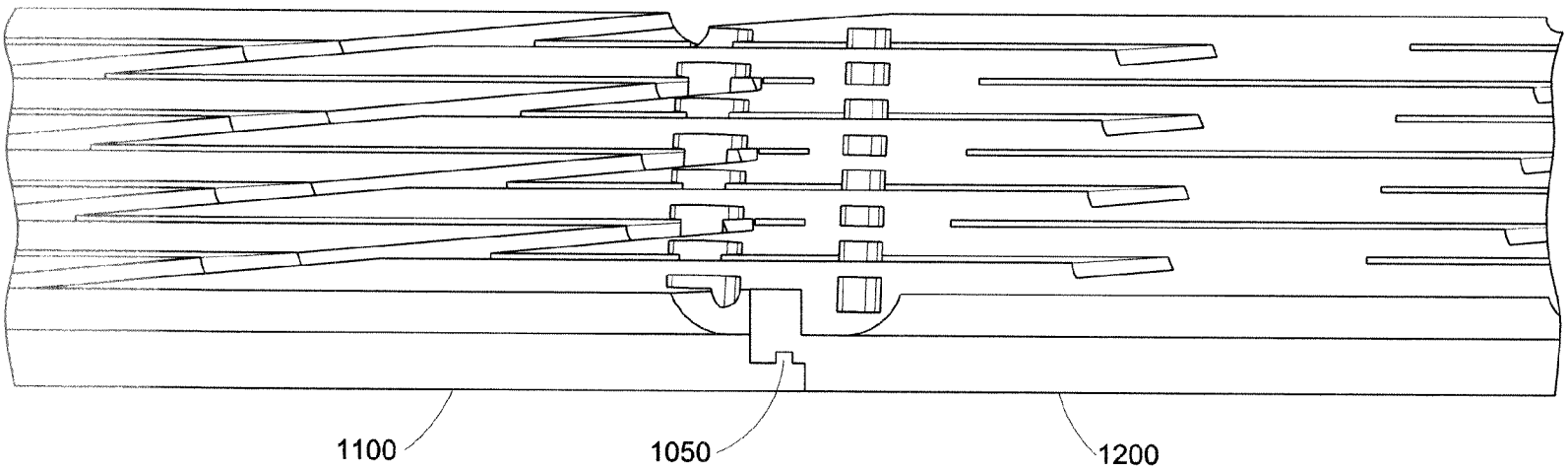
FIG. 18 is a bottom perspective view showing the connection between two sheathing panels of the present disclosure.

FIG. 17 is a front view of another exemplary embodiment of a sheathing panel 1000. A plurality of slots 1010 and rows 1020 can be seen in this view. Holes 130 are shown here at intervals to serve as attachment sites for the sheathing panel. Nails, staples, and other similar fasteners may be used at the attachment site to connect the sheet to the exterior wall. Alternatively, the sheathing panel may be adhered to the exterior wall with an adhesive material spread on the wall. Grooves 1040 are also located in the sheathing panel at intervals to manage the flow of water that gets into the sheathing panel. The grooves are shown as being cut along the front surface of the sheathing panel, though they could be placed along the rear surface of the sheathing panel as well. Along the right and left edges 1002, 1004 of the sheathing panel are complementary connecting members 1050 for connecting adjacent sheathing panels. FIG. 18 shows two sheathing panels 1100, 1200 being connected. Here, a tongue and groove relationship is shown.

Other exemplary embodiments of various sheathing panels and siding panels are also within the scope of this disclosure. Referring to embodiments shown in FIGS. 19-21, the sheathing panel 1320 comprises a front surface 1322 and a rear surface 1324. The front surface 1322 comprises a slot 1330. The slot 1330 has a slot entry height 1335 and extends rearwards into the sheathing panel 1320 to form a cavity 1340. The height 1345 of the cavity is greater than the slot entry height 1335. The cavity 1340 may also be described as including a downwardly extending channel 1342 located along an upper surface 1332 of the slot 1330 and an upwardly extending channel 1344 located along a lower surface 1334 of the slot.

The siding panel 1350 comprises a front face 1352 and a rear face 1354. A connecting wall 1360 extends from the rear face 1354 to a rear wall 1362 extending transversely from the connecting wall. The rear wall has a height 1365 that is greater than the slot entry height 1335. The connecting wall 1360 may have a width 1368 that is equal to or greater than the width 1358 of the upper edge 1356 of the siding panel 1330.

As shown here, the rear wall 1362 of the siding panel 1330 is sized to substantially fill the cavity 1340. In some embodiments, the connecting wall 1360 and the rear wall 1362 of the siding panel are sized to substantially fill the slot 1330. The rear wall 1362 may extend substantially perpendicularly from the connecting wall. The rear wall 1362 may comprise an upper portion 1364 extending transversely above the connecting wall 1360 and a lower portion 1366 extending transversely below the connecting wall.

Figure 21:
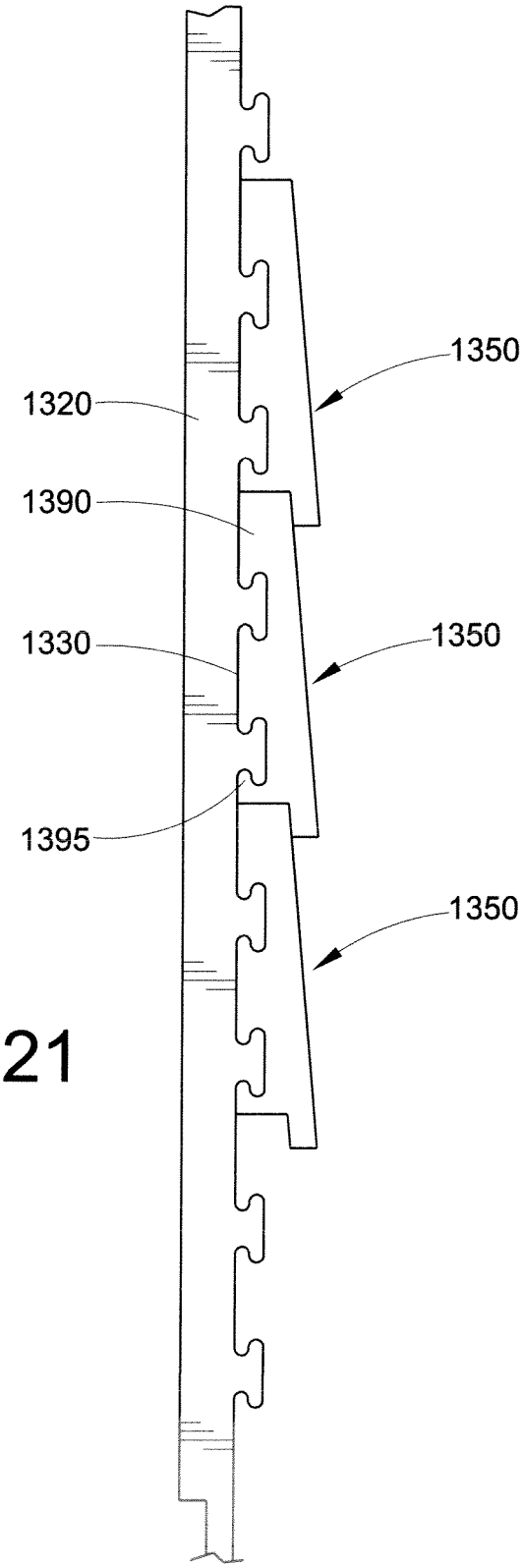
FIG. 21 is a side view of an exemplary embodiment of the panels of FIGS. 19 and 20 attached to each other.

The siding panel 1330 may also comprise an upper connecting wall 1370 extending from the rear face 1354, an upper rear wall 1372 extending downwards from the upper connecting wall, an lower connecting wall 1380 extending from the rear face, and a lower rear wall 1382 extending upwards from the lower connecting wall. As seen in FIG. 21, the upper connecting wall 1370, upper rear wall 1372, lower connecting wall 1380, and lower rear wall 1382 can be used to further secure the siding panel by fitting into parts of two other slots 1390, 1395. Put another way, these additional connecting walls and rear walls are sized to collectively fill the cavity of one slot.

Figure 22:
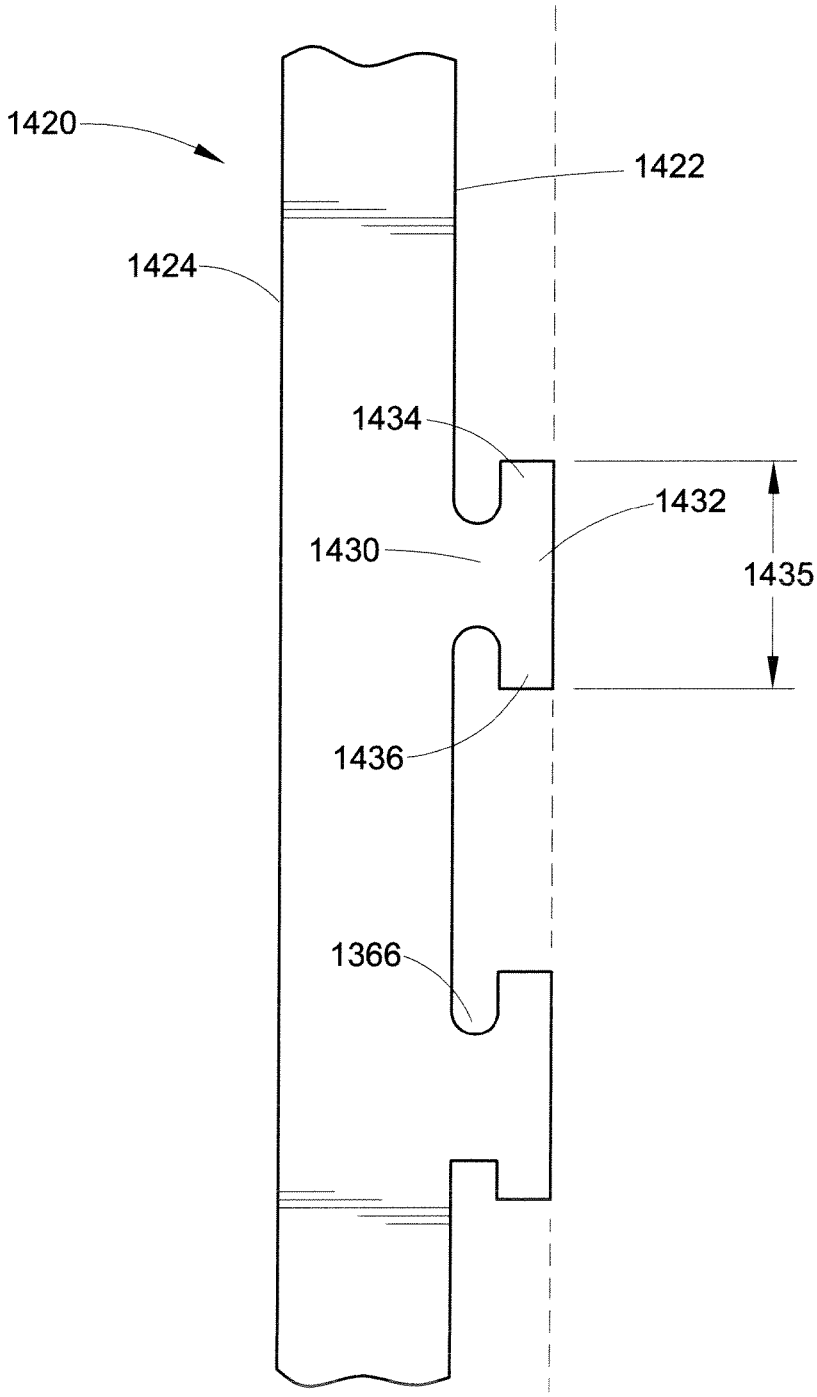
FIG. 22 is a side view of another exemplary embodiment of a sheathing panel used in the present disclosure.
Figure 23:
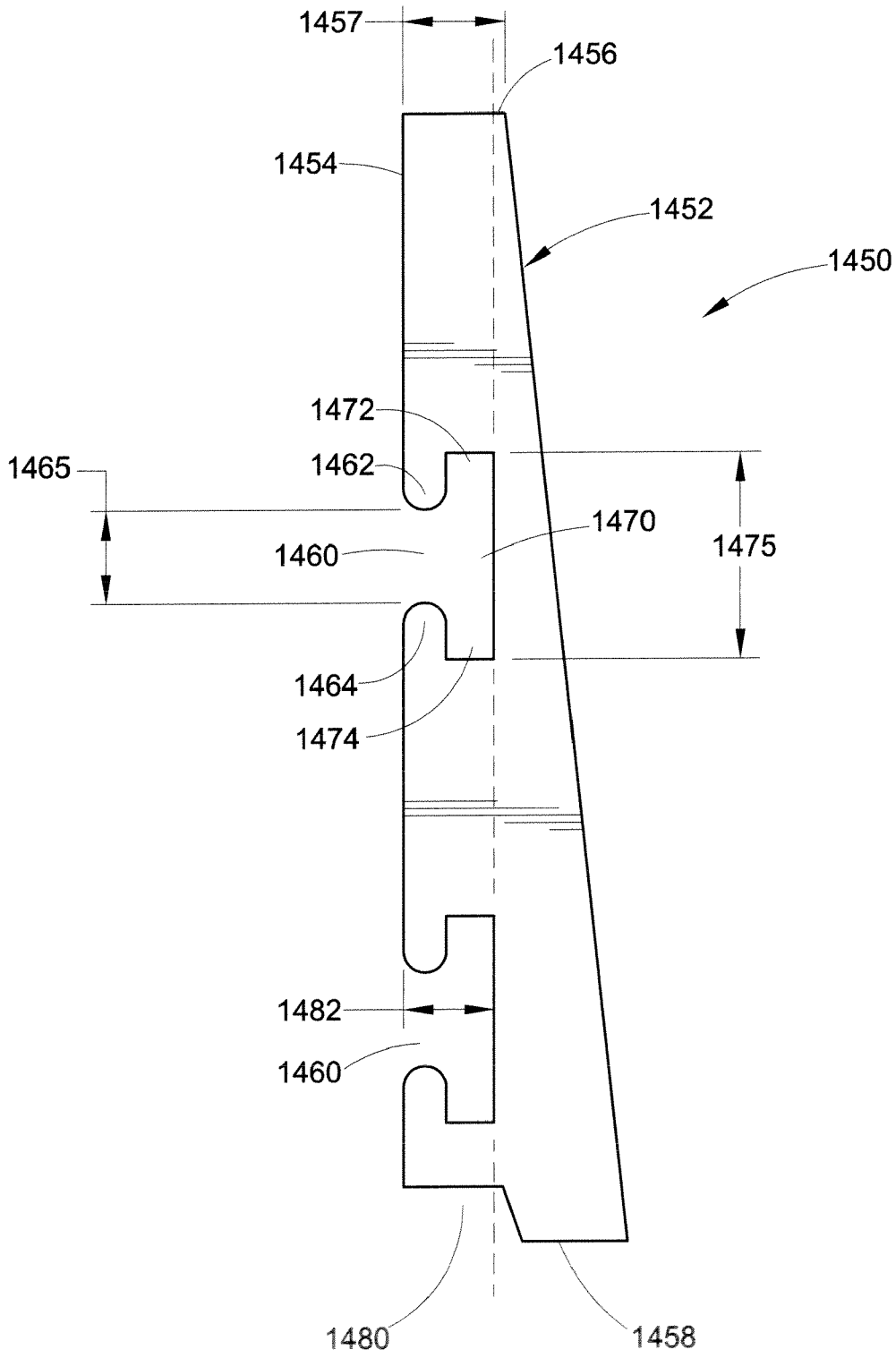
FIG. 23 is a side view of another exemplary embodiment of a siding panel used in the present disclosure.

Referring to FIGS. 22 and 23, the siding panel 1450 may alternatively be described as comprising a front face 1452 and a rear face 1454. The rear face comprises at least one receptacle 1460, including at least two receptacles. The receptacle has a receptacle entry height 1465 and extends into the siding panel to form a cavity 1470. The cavity has a cavity height 1475 which is greater than the receptacle entry height 1465. Though not shown here, if desired, a veneer panel, similar to that shown in FIG. 15, may be attached to the front face 1452. The sheathing panel 1420 may alternatively be described as comprising a front face 1422 and a rear face 1424. A connecting wall 1430 extends from the front face to a front wall 1432 extending transversely from the connecting wall. The height 1435 of the front wall 1432 is greater than the receptacle entry height 1465. The cavity 1470 may also be described as including a downwardly extending channel 1472 located along an upper surface 1462 of the receptacle 1460 and an upwardly extending channel 1474 located along a lower surface 1464 of the receptacle.

The front wall 1432 of the sheathing panel is sized to substantially fill the cavity 1470. In other embodiments, the connecting wall 1430 and the front wall 1432 of the sheathing panel are sized to substantially fill the receptacle 1460. The front wall 1432 may extend substantially perpendicularly from the connecting wall. The front wall 1432 may also comprise an upper portion 1434 extending transversely above the connecting wall 1430 and a lower portion 1436 extending transversely below the connecting wall.

The siding panel 1450 also has an upper edge 1456 and a lower edge 1458. In some embodiments, the lower edge 1458 includes a recess 1480 having a width 1482 that is equal to or greater than the width 1457 of the upper edge 1456.

In these insulated siding systems shown in FIGS. 19-23, the siding panel is integrated with the sheathing panel by sliding the siding panel from the side into the sheathing panel. Unlike the siding panels shown in FIGS. 1-18, these siding panels cannot be inserted into the sheathing panel from the front. However, if desired, the siding panels of FIGS. 1-18 could be used with the sheathing panel of FIGS. 19 and 22.

Figure 24:
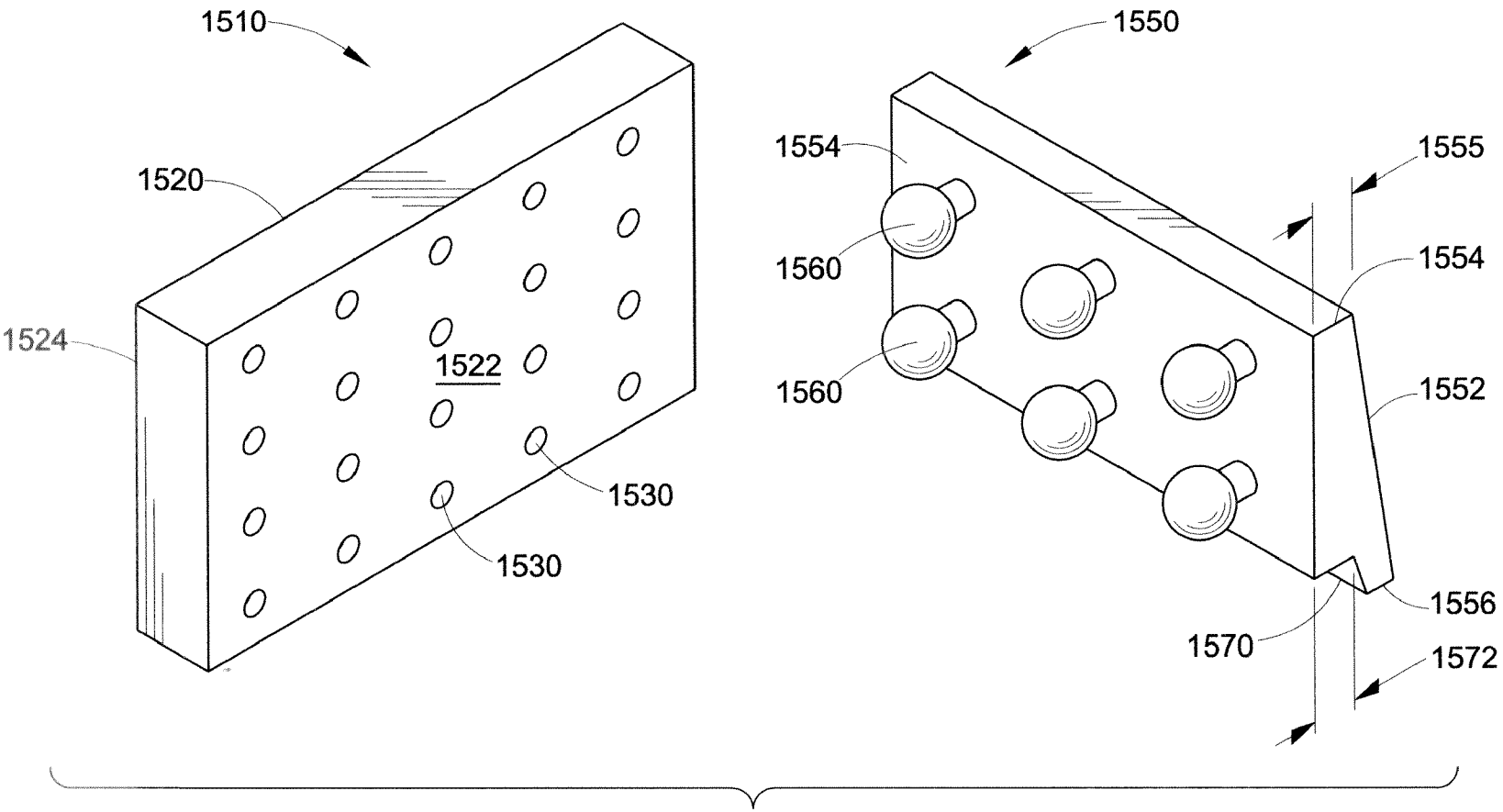
FIG. 24 is a perspective view of another exemplary embodiment of a sheathing panel and a siding panel of the present disclosure.
Figure 25:
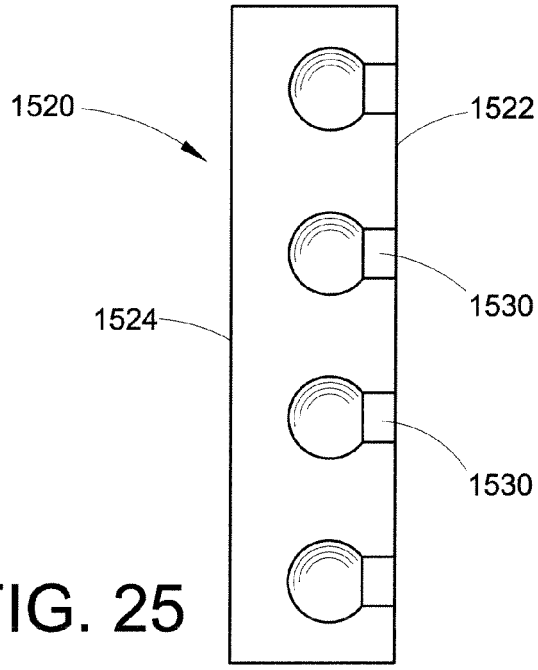
FIG. 25 is a side view of the sheathing panel of FIG. 24.
Figure 26:
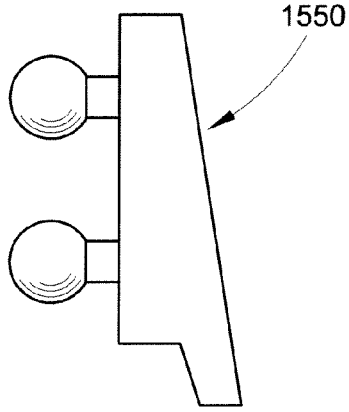
FIG. 26 is a side view of the siding panel of FIG. 24.

FIGS. 24-26 show yet another exemplary embodiment of an insulated siding system 1510. Again, the sheathing panel 1520 has a front face 1522 and a rear face 1524. Here, rather than continuous slots running the length of the sheathing panel along the front face, the front face 1522 comprises a plurality of sockets 1530. The siding panel 1550 comprises a front face 1552 and a rear face 1552. Instead of channels, a plurality of plugs 1560 extend from the rear face. At least two plugs are generally required to prevent the siding panel from rotating; here, the siding panel is depicted as having six plugs. Again, the lower edge 1556 of the siding panel 1550 may include a recess 1570 having a width 1572 that is equal to or greater than the width 1555 of the upper edge 1554 of the siding panel. The siding panel is attached to the sheathing panel by pushing the plugs 1560 of the siding panel into the sockets 1530 on the front of the sheathing panel. Of course, not all sockets must receive a plug. As depicted in FIG. 24 the sheathing pane 1520 and siding panel 1550 are joined together by a ball-and-socket arrangement. Of course, the roles may be reversed if desired, so that the rear face of the siding panel comprises a plurality of sockets and the front face of the sheathing panel comprises a plurality of plugs. The plug can be shaped, if desired, with a tapered surface that makes inserting the plug into the socket easy, but removing the plug difficult, such as with a snap-fit mechanism.

Figure 19:
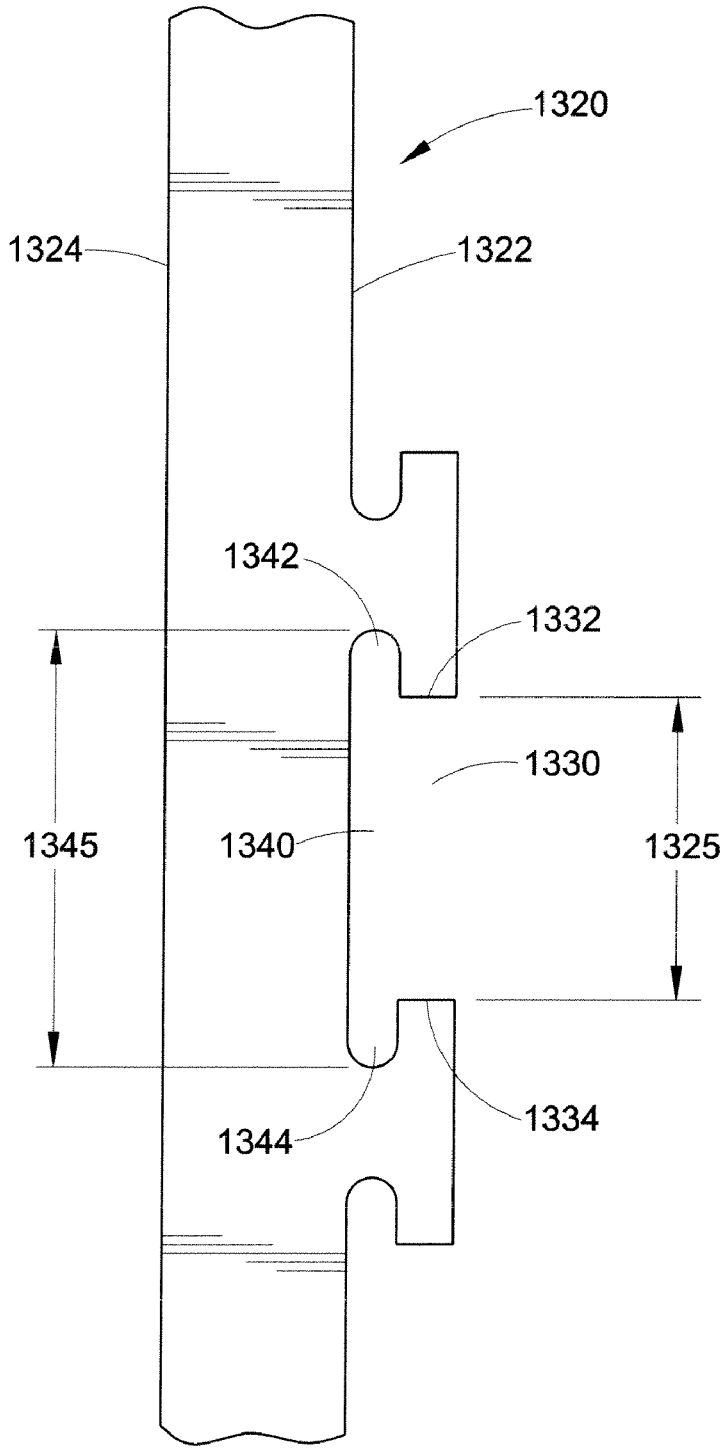
FIG. 19 is a side view of another exemplary embodiment of a sheathing panel used in the present disclosure.
Figure 20:
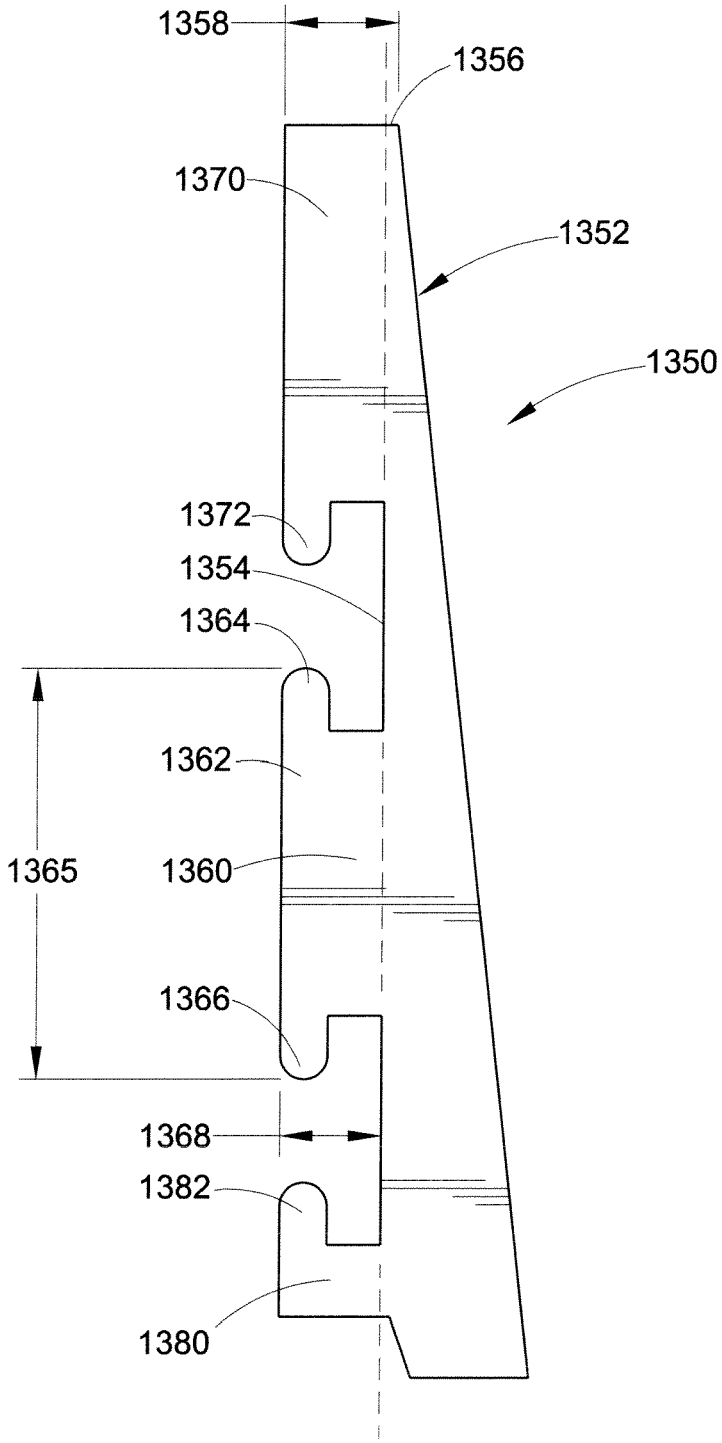
FIG. 20 is a side view of another exemplary embodiment of a siding panel used in the present disclosure.

Interestingly, in this embodiment, the cross-section of the sheathing panel 1520 shown in FIG. 25 is very similar to the sheathing panel 1320 of FIG. 19 and the cross-section of the siding panel 1550 shown in FIG. 26 is very similar to the siding panel 1350 of FIG. 20. For example, the socket 1530 could be considered a cavity 1340 and the plug 1560 could be considered a combination of the connecting wall 1360 and rear wall 1362. However, unlike the combination of FIGS. 19 and 20, the siding panel of FIG. 25 must be inserted from the front, not the side.

If desired, the insulating panel (reference numeral 90 in FIG. 2) can be attached to the siding panel (reference numeral 50 in FIG. 2) in a variety of ways including, but not limited to, adhesive, chemical bonding, interlocking complementary surfaces, and/or fasteners. Typically, however, adhesives are used. The adhesive may be used over the entire surface of the siding panel or in discrete locations instead. Suitable adhesives may include, but are not limited to, UV curable adhesives and hot melt adhesives, such as polyamines and urethanes, glue, thermosetting or thermoplastic adhesives, pressure sensitive adhesives or solvent-based adhesives.

The sheathing panel and/or the insulating panel, when present, may be shape molded. Such molding operations will generally impart the desired contours and/or design to the sheathing panel. Typically, pellets of a polymeric precursor material are placed in a suitably configured die mold, then reacted in the presence of water and heat to expand during the reaction process. The polymeric precursor material expands and presses against the die surface to form compressed elongated closed cells that form a characteristic tough smooth skin. The shape molded process produces a panel that is essentially straight, free of camber, and/or self-supporting. The various grooves, slots, and channels of the sheathing panel may be obtained by any combination of computer numerical control (CNC) cutting, milling, wire-cutting, or during the shape molding process as well.

The sheathing panel and/or insulating panel is generally made from a cellular foam product, i.e. a plastic or polymeric material with numerous cells of trapped air distributed throughout its mass. For example, expanded polystyrene (EPS) is a cellular foam plastic made from beads of polystyrene beads that are first pre-expanded and allowed to rest for a suitable interval, then molded in closed steam-heated shaped molds to produce closed-cell molded foams. The size and density of the closed cells can be controlled and may vary depending upon the application. Suitable materials for the sheathing panel can include expandable polystyrene (XPS), expanded polystyrene (EPS), polyurethane, polyisocyanurate, polyethylene, polypropylene, or combinations thereof.

The sheathing panel and/or insulating panel can be of any density desired, or be tuned to provide different densities depending on the location. For example, it may be desirable to have higher densities where the sheathing panel is thin, and lower densities where the panel is thicker. Similarly, it may be desirable to have higher densities near the edges of the insulating panel, and lower densities near the center of the insulating panel (where it is covered by the siding panel).

Expanded or expandable polystyrene are particularly desirable materials for the sheathing panel and/or insulating panel because they provide a solid feel; improve the R-value; deaden noise transmitted through the siding; and channel heat and water away into the external environment, protecting the exterior wall behind the sheathing panel and reducing mold growth.

Figure 27:
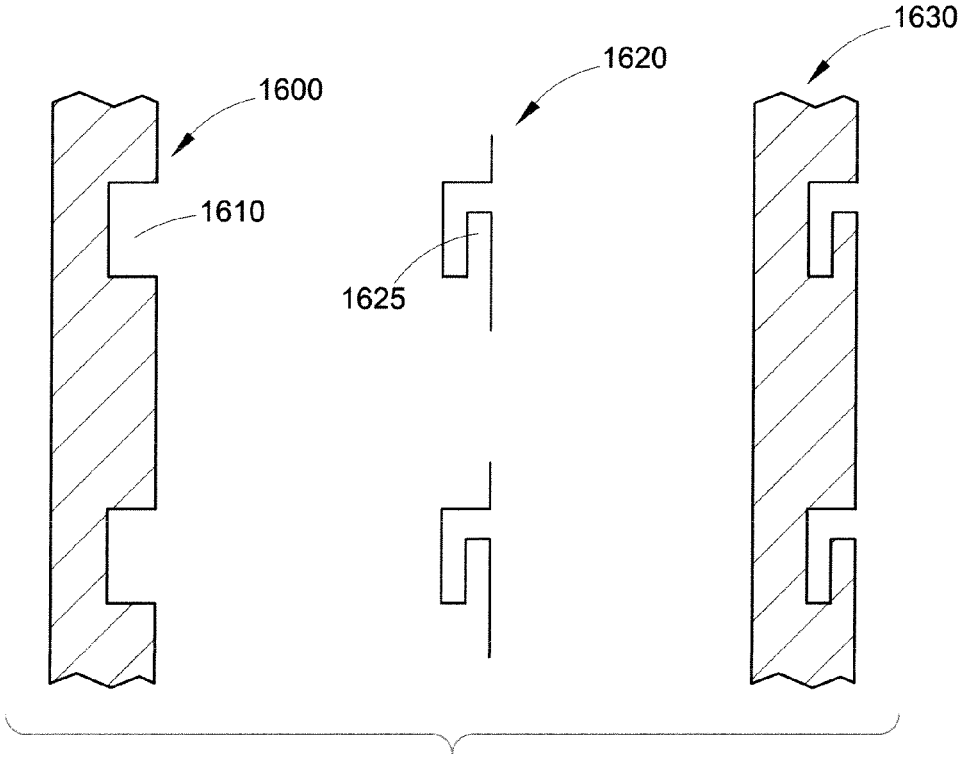
FIG. 27 is a diagram showing one method for constructing a sheathing panel of the present disclosure.

The various slots, grooves, and channels could also be made out of different materials, such as plastics or metals, instead of being milled or wire-cut from a foamed sheet. For example, the rows, ridges, and lips could be inserted into a flat foamed sheet and fastened with adhesive, tape, screws, or other mechanical fasteners. Alternatively, the rows, ridges, and lips may be inserted into the foamed sheet and fastened mechanically during the shape molding process. The plastic or metal piece could be inserted and the foam would be expanded and fused around it. No secondary fasteners or additional fastening step would be required. FIG. 27 illustrates this method of making the slots in the sheathing panel. Here, a foam sheet 1600 is partially foamed to include holes 1610 into which plastic or metal pieces 1620 are inserted. The foam sheet is then expanded around the piece 1620 to form the final sheathing panel 1630 and fix the piece 1620 in place. For example, the piece 1620 has a lip 1625 which is filled with foam in the sheathing panel 1630.

The siding panel can generally be formed from any suitable polymeric, metallic, cementious or composite material. Exemplary materials include vinyl, polypropylene, fiber-cement material, polyolefins, polyvinyls, polycarbonates, polyacetals, polysulfones, polyesters, polyamides, multilayer films, polyethylene (HDPE), polypropylene, low density polyethylene (LDPE), CPVC ABS, ethyl-vinyl acetate, various extruded ionomeric films, polyethylene based films, or combinations thereof. Other siding materials suitable for the siding layer include wood, aluminum, and steel.

Generally, siding must be thick to resist sagging and retain the desired shape. However, the insulating panel allows the siding panel to be thinner than otherwise necessary. The siding panel only has to provide weatherability to the siding panel assembly. Whereas traditional vinyl veneer sidings have a minimum material thickness of 0.040 inches, the siding panels of the present disclosure may have a thickness from 0.020 to 0.036 inches.

The downwardly facing channels or connectors can be made integral with the front face of the siding panel, or as separate pieces attached to the front face.

In embodiments such as that shown in FIG. 15, the siding panel is generally made from a cellular foam product, as described above with respect to the insulating panel. The veneer panel can be made from suitable materials as described with respect to the siding panel.

The sheathing panel can have a length of between 12 and 240 inches and will typically have lengths of 48 to 96 inches, as desired or required. The sheathing panel's height may be between 12 and 240 inches, and the sheathing panel may have a width (from rear surface to front surface) of 0.1875 to 36 inches. The siding panel or veneer panel can have a total thickness of from about 0.2 to about 4 inches.

The sheathing panels and siding panels are used in suitable combinations as insulating siding systems of the present disclosure to be affixed to or attached to exterior walls of a building. The foam sheathing with integral receivers/connectors allow easy, straight alignment and fastening of the siding panels without the use of fasteners that must go through the siding panel. The combination of the slots/channels of the sheathing panel with the siding panels above and below generally restrict the movement of a siding panel in any direction. Installation and alignment of the siding panels is made easier. Because the siding panels present a solid, unpenetrated façade, there are fewer places through which moisture can penetrate into the exterior wall. Defects related to the expansion of the siding panels is also minimized.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An insulating siding system comprising a foam sheathing panel, a foam insulating panel, and a siding panel;

the sheathing panel comprising a front surface and a rear surface, the front surface and rear surface being spaced laterally apart from each other, the front surface comprising a first slot, the first slot extending laterally into the sheathing panel and including an upwardly facing channel spaced laterally from the front surface; and the siding panel comprising a front face, a rear face, and a first downwardly facing channel that extends rearwards, wherein the channel is defined by the rear face, a planar upper channel wall, and a rear wall;

wherein the first slot is sized to receive the rear wall of the first downwardly facing channel; and wherein the insulating panel extends up to the upper channel wall and is sized and shaped to fit between the rear face of the siding panel, the rear wall, and the front surface of the sheathing panel when the first slot receives the rear wall of the first downwardly facing channel.

2. The insulating siding system of claim 1, wherein the upwardly facing channel of the first slot has a height that is equal to or greater than a height of the first downwardly facing channel rear wall.

3. The insulating siding system of claim 1, wherein the first downwardly facing channel extends rearwards from an upper edge of the siding panel.

4. The insulating siding system of claim 1, wherein the siding panel further comprises a second downwardly facing channel extending rearwards from a lower edge of the siding panel.

5. The insulating siding system of claim 4, wherein the siding panel further comprises a lower upwardly facing channel located between the lower edge of the siding panel and the second downwardly facing channel.

6. The insulating siding system of claim 5, wherein the insulating panel has an upper edge and a lower edge, the upper edge of the insulating panel extending into the first downwardly facing channel and the lower edge of the insulating panel extending into the lower upwardly facing channel.

7. The insulating siding system of claim 6, wherein the first downwardly facing channel is sized so as to contain the upper edge of the insulating panel and a lip of the first slot.

8. The insulating siding system of claim 4, wherein the second downwardly facing channel comprises a rear wall which is sized so as to be received by the first slot of the sheathing panel.

9. An insulating siding system comprising a foam sheathing panel, a foam insulating panel, and a siding panel;

the sheathing panel comprising a front surface and a rear surface, the front surface and rear surface being spaced laterally apart from each other, the front surface comprising a first slot and a second slot, each slot comprising an upper surface extending laterally into the front surface, a rear surface extending downwards from the upper surface, a lower surface extending from the rear surface laterally towards the front surface for a lower surface width, a forward surface extending upwards from the lower surface for a forward surface height, a medial surface extending from the forward surface to the front surface for a medial surface width, and a slot entry height between the upper surface and the medial surface; and the siding panel comprising a front face and a rear face, an upper channel wall extending rearwards from the rear face and having an upper channel wall width, an upper channel rear wall extending downwards from the upper channel wall and having an upper rear wall height, a bottom wall extending rearwards from the rear face, a lower channel front wall extending upwards from the bottom wall, a lower channel top wall extending rearwards from the lower channel front wall and having a lower top wall width, and a lower channel rear wall extending downwards from the lower channel top wall and having a lower rear wall height;

wherein the slot entry height of the first slot is equal to or greater than the upper rear wall height and the slot entry height of the second slot is equal to or greater than the lower rear wall height;

wherein the insulating panel is sized and shaped to fit between the rear face of the siding panel and the front surface of the sheathing panel; and wherein the insulating panel has an upper edge and a lower edge, the upper edge of the insulating panel extending upwardly past an edge of the upper channel rear wall and the lower edge of the insulating panel extending into a channel formed by the lower channel front wall, the bottom wall, and the front face.

10. The insulating siding system of claim 9, wherein the insulating panel has an upper edge width, and the upper channel wall width is equal to or greater than the sum of the insulating panel upper edge width and the medial surface width.

11. The insulating siding system of claim 9, wherein the lower top wall width is equal to or greater than the upper channel wall width.

12. The insulating siding system of claim 9, wherein the ratio of the slot entry height to the forward surface height for each slot is independently from about 1:2 to about 2:1.

13. The insulating siding system of claim 9, wherein the upper channel wall extends rearwards at an upper edge of the siding panel, and the bottom wall extends rearwards at a lower edge of the siding panel.

14. An insulating siding system comprising a sheathing panel, an insulating panel, and a siding panel;

the sheathing panel comprising a front surface and a rear surface, the front surface and rear surface being spaced laterally apart from each other, the front surface comprising a first slot, the first slot extending laterally into the sheathing panel and including an upwardly facing channel spaced laterally from the front surface; and the siding panel comprising a front face, a rear face, a first downwardly facing channel that extends rearwards from an upper edge of the siding panel, wherein the channel is defined by the rear face, a planar upper channel wall, and a rear wall, a second downwardly facing channel extending rearwards from a lower edge of the siding panel, and a lower upwardly facing channel located between the lower edge of the siding panel and the second downwardly facing channel;

wherein the first slot is sized to receive the rear wall of the first downwardly facing channel;

wherein the insulating panel extends up to the upper channel wall and is sized and shaped to fit between the rear face of the siding panel, the rear wall, and the front surface of the sheathing panel when the first slot receives the rear wall of the first downwardly facing channel;

wherein the insulating panel has an upper edge and a lower edge, the upper edge of the insulating panel extending into the first downwardly facing channel and the lower edge of the insulating panel extending into the lower upwardly facing channel; and wherein the first downwardly facing channel is sized so as to contain the upper edge of the insulating panel and a lip of the first slot.

* * * * *